US009865247B2

(12) United States Patent
Agiomyrgiannakis et al.

(10) Patent No.: US 9,865,247 B2
(45) Date of Patent: Jan. 9, 2018

(54) DEVICES AND METHODS FOR USE OF PHASE INFORMATION IN SPEECH SYNTHESIS SYSTEMS

(71) Applicant: Google LLC, Mountain View, CA (US)

(72) Inventors: Ioannis Agiomyrgiannakis, London (GB); Byung Ha Chun, Epsom (GB)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/631,583

(22) Filed: Feb. 25, 2015

(65) Prior Publication Data

US 2016/0005391 A1 Jan. 7, 2016

Related U.S. Application Data

(60) Provisional application No. 62/020,781, filed on Jul. 3, 2014.

(51) Int. Cl.

| | |
|---|---|
| ***G10L 13/08*** | (2013.01) |
| ***G10L 25/75*** | (2013.01) |
| ***G10L 13/02*** | (2013.01) |

(52) U.S. Cl.

CPC ..... *G10L 13/02* (2013.01); *G10L 13/08* (2013.01); *G10L 25/75* (2013.01)

(58) Field of Classification Search

CPC ..... G10L 13/02; G10L 13/08; G10L 25/15; G10L 25/30; G10L 25/75

USPC ..... 704/258–259, 261, 266–267

See application file for complete search history.

(56) References Cited

U.S. PATENT DOCUMENTS

| | | | | |
|---|---|---|---|---|
| 3,982,070 | A | 9/1976 | Flanagan | |
| 5,664,051 | A | 9/1997 | Hardwick et al. | |
| 8,401,849 | B2 | 3/2013 | Chandra et al. | |
| 8,527,276 | B1 | 9/2013 | Senior et al. | |
| 2006/0229868 | A1* | 10/2006 | Bozkurt | G10L 19/04 704/206 |
| 2011/0276332 | A1* | 11/2011 | Maia | G10L 13/08 704/260 |

(Continued)

FOREIGN PATENT DOCUMENTS

WO 2014021318 A1 2/2014

OTHER PUBLICATIONS

Agiomyrgiannakis, et al. "Stochastic modeling and quantization of harmonic phases in speech using wrapped gaussian mixture models." Acoustics, Speech and Signal Processing, 2007. ICASSP 2007. IEEE International Conference on. vol. 4. IEEE, Apr. 2007, pp. 1121-1124.*

(Continued)

*Primary Examiner* — James Wozniak

(74) *Attorney, Agent, or Firm* — Fish & Richardson P.C.

(57) ABSTRACT

A device may receive a speech signal. The device may determine acoustic feature parameters for the speech signal. The acoustic feature parameters may include phase data. The device may determine circular space representations for the phase data based on an alignment of the phase data with given axes of the circular space representations. The device may map the phase data to linguistic features based on the circular space representations. The linguistic features may be associated with linguistic content that includes phonemic content or text content. The device may provide a synthetic audio pronunciation of the linguistic content based on the mapping.

17 Claims, 11 Drawing Sheets

(56) References Cited

U.S. PATENT DOCUMENTS

2012/0265534 A1* 10/2012 Coorman ..... G10L 13/033 704/265
2013/0262087 A1* 10/2013 Ohtani ..... G10L 13/02 704/9

OTHER PUBLICATIONS

Degottex, Gilles, et al. "A uniform phase representation for the harmonic model in speech synthesis applications." EURASIP Journal on Audio, Speech, and Music Processing 2014.1, Dec. 2014, pp. 1-16.*
Erro, Daniel, Eva Navas, and Inma Hernaez. "Parametric voice conversion based on bilinear frequency warping plus amplitude scaling." Audio, Speech, and Language Processing, IEEE Transactions on 21.3, Mar. 2013, pp. 556-566.*
Hosseinpour, et al. "LSF and Phase Feature Combination for Join Cost Estimation in a TTS System." Signal Processing and Communications, 2007. ICSPC 2007. IEEE International Conference on. IEEE, Nov. 2007, pp. 237-240.*
Pengfei, et al. "Quantization of the Parameters of a Harmonic-Plus-Noise Model for Corpus-Based Text-To-Speech Synthesis," 2007, pp. 1-31.*
Petrovsky, et al. "Hybrid signal decomposition based on instantaneous harmonic parameters and perceptually motivated wavelet packets for scalable audio coding." Signal processing 91.6, Jun. 2011, pp. 1489-1504.*
Sailor, et al. "Fusion of magnitude and phase-based features for objective evaluation of TTS voice." Chinese Spoken Language Processing (ISCSLP), 2014 9th International Symposium on. IEEE, Sep. 2014, pp. 521-525.*
Shukla, Sunil Ravindra. "Improving High Quality Concatenative Text-to-Speech Using the Circular Linear Prediction Model." May 2007, pp. 1-143.*
Drugman, Thomas, Baris Bozkurt, and Thierry Dutoit. "Causal-anticausal decomposition of speech using complex cepstrum for glottal source estimation." Speech Communication 53.6, Jul. 2011, pp. 855-866.*
Maia, Ranniery, Masami Akamine, and Mark JF Gales. "Complex cepstrum for statistical parametric speech synthesis." Speech Communication 55.5, Jun. 2013, pp. 606-618.*
Nakagawa, Seiichi, Longbiao Wang, and Shinji Ohtsuka. "Speaker identification and verification by combining MFCC and phase information." IEEE transactions on audio, speech, and language processing 20.4 , Feb. 2012, pp. 1085-1095.*
De Leon, Phillip L., et al. "Evaluation of speaker verification security and detection of HMM-based synthetic speech." IEEE Transactions on Audio, Speech, and Language Processing 20.8, Oct. 2012, pp. 2280-2290.*
Saratxaga, Ibon, et al. "Simple representation of signal phase for harmonic speech models." Electronics letters 45.7, Mar. 2009, pp. 1-2.*
Saratxaga, Ibon, et al. "AhoTransf: A Tool for Multiband Excitation Based Speech Analysis and Modification." LREC, May 2010, pp. 3732-3737.*
Joao Paulo Serrasqueiro Robalo Cabral, HMM-based Speech Synthesis Using an Acoustic Glottal Source Model, PhD Thesis, The Centre for Speech Technology Research Institute for Communicating and Collaborative Systems School of Informatics, University of Edinburgh, 2010.
Hochreiter et al., "Long Short-Term Memory," Neural Computation Journal, vol. 9, No. 8, pp. 1735-1780, 1997.
Drugman et al., "Complex Cepstrum-based Decomposition of Speech for Glottal Source Estimation," Proc. Interspeech Conf., 2009.
Christopher M. Bishop, "Mixture Density Networks," Neural Computing Research Group, Department of computer Science and Applied Mathematics, Aston University, Birmingham. B4 7ET, U.K., 1994.
Babacan et al., "A Quantitative Comparison of Glottal Closure Instant Estimation Algorithms on a Large Variety of Singing Sounds," Proceedings of the 14th Conference of the International Speech Communication Association, pp. 1-5, 2013.
Agiomyrgiannakis et al., "Wrapped Gaussian Mixture Models for Modeling and High-Rate Quantization of Phase Data of Speech," IEEE Transactions on Audio, Speech and Language Processing, vol. 17, No. 4, May 2009, pp. 775-786.
Zen et al., "Statistical Parametric Speech Synthesis Using Deep Neural Networks," Acoustics, Speech and Signal Processing (ICASSP), 2013 IEEE International Conference on, pp. 7962-7966, 2013.
Tokuda et al., "Mel-Generalized Cepstral Analysis—A Unified Approach to Speech Spectral Estimation," ICSLP, 1994.
Yannis Stylianou, "Applying the Harmonic Plus Noise Model in Concatenative speech Synthesis," IEEE Transactions on Speech and Audio Processing, vol. 9, No. 1, Jan. 2001, pp. 21-29.
Mike Schuster, "Better Generative Models for Sequential Data Problems: Bidirectional Recurrent Mixture Density Networks," Advances in Neural Information Processing Systems 12, NIPS Proceedings, pp. 589-594, 1999.
Saratxaga et al., "Perceptual Importance of the Phase Related Information in Speech," INTERSPEECH—2012, pp. 1448-1451, 2012.
Raitio et al., "HMM-Based Speech Synthesis Utilizing Glottal Inverse Filtering," IEEE Transactions on Audio Speech and Language Processing, vol. 19, No. 1, Jan. 2011, pp. 153-165.
Naylor et al., "Estimation of Glottal Closure Instants in Voiced Speech Using the DYPSA Algorithm," IEEE Transactions on Augio, Speech and Language Processing, vol. 15, No. 1, Jan. 2007, pp. 34-43.
Ian Vince McLoughlin, "A review of Line Spectral Pairs," School of Computer Engineering, Nanyang Technological University, 2007.
Hideki Kawahara, "STRAIGHT, exploitation of the other aspect of VOCODER: Perceptually isomorphic decomposition of speech sounds," Acoust. Sci, and Tech. 27, 6 (2006) pp. 349-353.
Tokuda et al., "Speech Parameter Generation Algorithms for HMM-Based Speech Synthesis," International Conference, vol. 3, pp. 1315-1318, IEEE, 2000.
Cabral et al., "An HMM-based speech synthesiser using Glottal Post-Filtering," Proc. 7th ISCA Speech Synthesys Workshop (SSW7), pp. 365-370, NICT/ATR, Kyoto, Japan, Sep. 2010.
STRAIGHT, http://www.wakayama-u.ac.jp/~kawahara/STRAIGHTadv/index_e.html, visited and printed from internet on May 10, 2014.
AHOcoder, http://aholab.ehu.es/ahocoder/info.html, visited and printed from internet on May 10, 2014.
Agiomyrgiannakis et al., "ARX-LF-Based Source-Filter Methods for Voice Modification and Transformation," IEEE Orange Labs, Tech-SSTP-VMI, Lannion, France, ICASSP 2009, pp. 3589-3592.
Pantazis et al., "Analysis/Synthesis of Speech Based on an Adaptive Quasi-Harmonic Plus Noise Model," IEEE, Institute of Computer Science, Forth and Multimedia Informatics Lab, CSD, UofC, Greece; Orange Labs Tech/ASAP/Voice, Lannion, France; ICASSP 2010, pp. 4246-4249.
Erro et al., "Harmonics Plus Noise Model Based Vocoder for Statistical Parametric Speech Synthesis," IEEE Journal of Selected Topics in Signal Processing, vol. 8, No. 2, Apr. 2014, pp. 184-194.
Aguilar et al., "An Embedded Sinusoidal Transform Codec With Measured Phases and Sampling Rate Scalability," IEEE 2000, Speech Technology Group VoIP Access Networks Lucent InterNetworking Systems Red Bank, New Jersey, Massachusetts Institute of Technology Cambridge, Massachusetts, pp. 1141-1144.
Maia et al., "Complex Cepstrum as Phase Information in Statistical Parametric Speech Synthesis," IEEE, Toshiba Research Europe Limited, Cambridge Research Laboratory, Cambridge, UK; Toshiba Corporation, Corporate Research and Development Center, Kawasaki, Japan, ICASSP 2012, pp. 4581-4584.

* cited by examiner

DEVICES AND METHODS FOR USE OF PHASE INFORMATION IN SPEECH SYNTHESIS SYSTEMS

CROSS-REFERENCE TO RELATED APPLICATION

This application claims priority to U.S. Provisional Patent Application Ser. No. 62/020,781, filed on Jul. 3, 2014, the entirety of which is herein incorporated by reference.

BACKGROUND

Unless otherwise indicated herein, the materials described in this section are not prior art to the claims in this application and are not admitted to be prior art by inclusion in this section.

Speech processing systems such as text-to-speech (TTS) systems and automatic speech recognition (ASR) systems may be employed, respectively, to generate synthetic speech from text and generate text from audio utterances of speech.

A first example TTS system may concatenate one or more recorded speech units to generate synthetic speech. A second example TTS system may concatenate one or more statistical models of speech to generate synthetic speech. A third example TTS system may concatenate recorded speech units with statistical models of speech to generate synthetic speech. In this regard, the third example TTS system may be referred to as a hybrid TTS system.

SUMMARY

In one example, a method is provided that includes a device receiving a speech signal. The device may include one or more processors. The method also includes determining acoustic feature parameters for the speech signal. The acoustic feature parameters may include phase data. The method also includes determining circular space representations for the phase data based on an alignment of the phase data with given axes of the circular space representations. The method also includes mapping the phase data to linguistic features based on the circular space representations. The linguistic features may be associated with linguistic content that includes phonemic content or text content. The method also includes providing a synthetic audio pronunciation of the linguistic content based on the mapping.

In another example, a computer readable medium is provided. The computer readable medium may have instructions stored therein that when executed by a computing device, cause the computing device to perform functions. The functions include receiving a speech signal. The functions also include determining acoustic feature parameters for the speech signal. The acoustic feature parameters may include phase data. The functions also include determining circular space representations for the phase data based on an alignment of the phase data with given axes of the circular space representations. The functions also include mapping the phase data to linguistic features based on the circular space representations. The linguistic features may be associated with linguistic content that includes phonemic content or text content. The functions also include providing a synthetic audio pronunciation of the linguistic content based on the mapping.

In yet another example, a device is provided that comprises one or more processors and data storage configured to store instructions executable by the one or more processors.

The instructions may cause the device to receive a speech signal. The instructions may also cause the device to determine acoustic feature parameters for the speech signal. The acoustic feature parameters may include phase data. The instructions may also cause the device to map the phase data to linguistic features based on the circular space representations. The linguistic features may be associated with linguistic content that includes phonemic content or text content. The instructions may also cause the device to provide a synthetic audio pronunciation of the linguistic content based on the map.

In still another example, a system is provided that comprises a means for a device receiving a speech signal. The device may include one or more processors. The system further comprises a means for determining acoustic feature parameters for the speech signal. The acoustic feature parameters may include phase data. The system further comprises a means for determining circular space representations for the phase data based on an alignment of the phase data with given axes of the circular space representations. The system further comprises a means for mapping the phase data to linguistic features based on the circular space representations. The linguistic features may be associated with linguistic content that includes phonemic content or text content. The system further comprises a means for providing a synthetic audio pronunciation of the linguistic content based on the mapping.

These as well as other aspects, advantages, and alternatives, will become apparent to those of ordinary skill in the art by reading the following detailed description, with reference where appropriate to the accompanying figures.

DETAILED DESCRIPTION

Figure 1A:
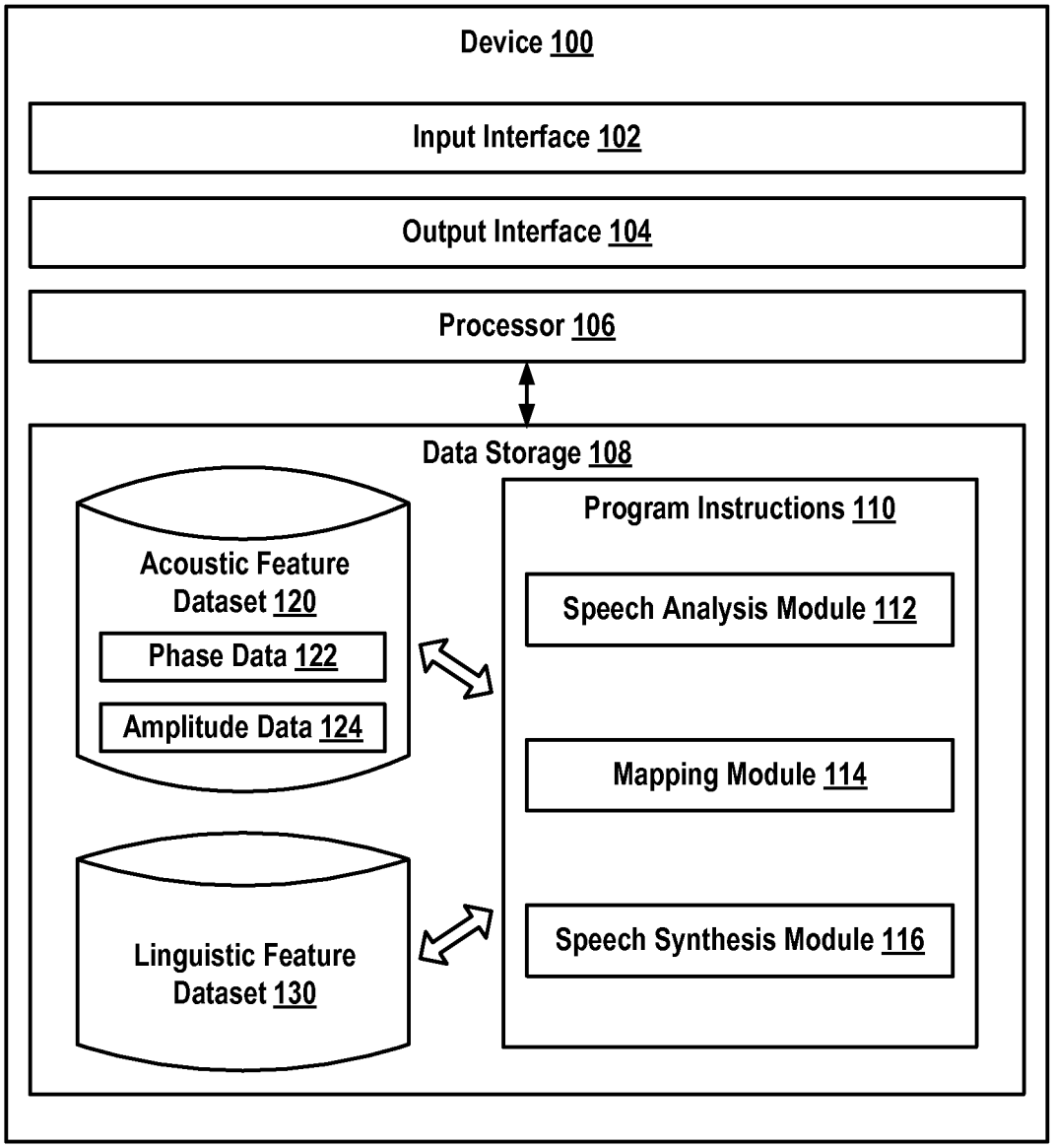
FIG. 1A illustrates an example device, in accordance with at least some embodiments described herein.

The following detailed description describes various features and functions of the disclosed systems and methods with reference to the accompanying figures. In the figures, similar symbols identify similar components, unless context dictates otherwise. The illustrative system, device and method embodiments described herein are not meant to be limiting. It may be readily understood by those skilled in the art that certain aspects of the disclosed systems, devices and methods can be arranged and combined in a wide variety of different configurations, all of which are contemplated herein.

Speech processing systems such as text-to-speech (TTS) systems, automatic speech recognition (ASR) systems, and/or speech restoration systems may be deployed in various environments to provide speech-based user interfaces or other speech-based output. Some of these environments may include residences, businesses, vehicles, etc.

In one example, a TTS may provide audio information from devices such as large appliances, (e.g., ovens, refrigerators, dishwashers, washers and dryers), small appliances (e.g., toasters, thermostats, coffee makers, microwave ovens), media devices (e.g., stereos, televisions, digital video recorders, digital video players), communication devices (e.g., cellular phones, personal digital assistants), as well as doors, curtains, navigation systems, and so on. For example, a navigation system that includes an ASR may receive an audio input from a user indicating an address, and the ASR may convert the audio input to a textual representation of the address. A TTS in the navigation system may then utilize the textual representation to obtain text that includes directions to the address, and then guide the user of the navigation system to the address by generating audio that corresponds to the text with the directions.

In another example, a speech restoration system may receive low-quality speech content such as, for example, speech recorded in harsh environmental conditions (e.g., windy, noisy, etc.). Such system, for example, may detect acoustic features in the input speech content and associate the acoustic features with linguistic features of linguistic content (e.g., text). For example, the acoustic features may be associated with a phonemic representation that includes a sequence of phonemes. In turn, for example, the system may output a synthetic audio pronunciation of the linguistic content as the restored speech content having higher quality than the input speech content.

Within examples, a device is provided that is configured to receive input indicative of speech. The device may be configured to determine acoustic feature parameters for the speech that include amplitude data and phase data. For example, the device may utilize various techniques (e.g., vocoder analysis techniques) that provide a parametric representation (e.g., spectral envelopes, aperiodicity envelopes, etc.) of the speech in the input. In the example, the device may then extract the amplitude data and the phase data at harmonic frequencies of the parametric representation.

The phase data, in some examples, may require a special representation to accommodate a circular (modulo-$2\pi$) behavior of the phase data. Accordingly, the device may be configured to determine representations for the phase data that are associated with a circular space, for example. Further, the device may be configured to map the phase data to linguistic features associated with linguistic content (e.g., text). The linguistic features, for example, may include phonetic features such as a phoneme, phone, diphone, triphone, etc., associated with speech sounds of the speech. Additionally, for example, the linguistic features may include context features such as preceding/following phonemes, position of speech sound within the speech, distance from stressed/accented syllable in the speech, prosodic context, length of speech sound, etc. Similarly, in some examples, the device may be configured to map the amplitude data to the linguistic features.

In some examples, the device may be configured to receive the linguistic content along with the speech in the input. For example, the linguistic content may include text that corresponds to the speech (e.g., the speech and the linguistic content may be training data for the device). In other examples, the linguistic content may be received as a separate input by the device for which the device may generate a synthetic audio pronunciation based on an analysis of the speech. Other examples are possible as well and are described in greater detail within embodiments of the present disclosure.

The device may also be configured to provide an output indicative of a synthetic audio pronunciation of the linguistic content based on the map between the phase data and the linguistic features. In one example, where concatenative speech synthesis is utilized, the device may identify a sequence of speech sounds in a speech corpus that are associated with the phase data (and/or the amplitude data) determined by the device. In another example, where statistical speech synthesis is utilized, the device may associate the phase data with one or more statistical models having a circular space. For example, a wrapped Gaussian Mixture Model (GMM) or decision tree-clustered wrapped Gaussian may be utilized to identify a sequence of phase probability density functions (pdfs) that provide a threshold likelihood of reproducing the speech in the input. In this example, the output, may be provided as a parametric representation that includes both amplitude information and phase information to a speech synthesizer (e.g., vocoder synthesizer, etc.) to generate a synthetic audio pronunciation of the linguistic content.

Referring now to the figures, FIG. 1A illustrates an example device 100, in accordance with at least some embodiments described herein. The device 100 includes an input interface 102, an output interface 104, a processor 106, and data storage 108.

The device 100 may include a computing device such as a smart phone, digital assistant, digital electronic device, body-mounted computing device, personal computer, server, or any other computing device configured to execute program instructions 110 included in the data storage 108 to operate the device 100. The device 100 may include additional components (not shown in FIG. 1A), such as a camera, an antenna, or any other physical component configured, based on the program instructions 110 executable by the processor 106, to operate the device 100. The processor 106 included in the device 100 may comprise one or more processors configured to execute the program instructions 110 to operate the device 100.

The input interface 102 may include an audio input device such as a microphone or any other component configured to provide an input signal comprising audio content associated with speech to the processor 106. Additionally or alternatively, the input interface 102 may include a text input device such as a keyboard, mouse, touchscreen, or any other component configured to provide an input signal comprising text content and or other linguistic content (e.g., phonemic content, etc.) to the processor 106.

The output interface 104 may include an audio output device, such as a speaker, headphone, or any other component configured to receive an output signal from the processor 106, and output speech sounds that may indicate synthetic speech content based on the output signal. Additionally or alternatively, the output interface 104 may include a display such as a liquid crystal display (LCD), light emitting diode (LED) display, projection display, cathode ray tube (CRT) display, or any other display configured to provide the output signal comprising linguistic content (e.g., text).

Additionally or alternatively, the input interface 102 and/or the output interface 104 may include network interface components configured to, respectively, receive and/or transmit the input signal and/or the output signal described above. For example, an external computing device (e.g., server, etc.) may provide the input signal (e.g., speech content, linguistic content, etc.) to the input interface 102 via a communication medium such as Wifi, WiMAX, Ethernet, Universal Serial Bus (USB), or any other wired or wireless medium. Similarly, for example, the external computing device may receive the output signal from the output interface 104 via the communication medium described above.

The data storage 108 may include one or more memories (e.g., flash memory, Random Access Memory (RAM), solid state drive, disk drive, etc.) that include software components configured to provide the program instructions 110 executable by the processor 106 to operate the device 100. Although FIG. 1A shows the data storage 108 physically included in the device 100, in some examples, the data storage 108 or some components included thereon may be physically stored on a remote computing device. For example, some of the software components in the data storage 108 may be stored on a remote server accessible by the device 100. The data storage 108 may include the program instructions 110, an acoustic feature dataset 120, and a linguistic feature dataset 130.

The program instructions 110 comprise various software components including a speech analysis module 112, a mapping module 114, and a speech synthesis module 116. The various software components 112-116 may be implemented, for example, as an application programming interface (API), dynamically-linked library (DLL), or any other software implementation suitable for providing the program instructions 110 to the processor 106.

The speech analysis module 112 may be configured to receive a speech signal (e.g., via the input interface 102) and provide an acoustic feature representation for the speech signal. The acoustic feature representation, for example, may include a parameterization of spectral/aperiodicity aspects (e.g., spectral envelope, aperiodicity envelope, etc.) for the speech signal that may be utilized to regenerate a synthetic pronunciation of the speech signal. Example spectral parameters may include Cepstrum, Mel-Cepstrum, Generalized Mel-Cepstrum, Discrete Mel-Cepstrum, Log-Spectral-Envelope, Auto-Regressive-Filter, Line-Spectrum-Pairs (LSP), Line-Spectrum-Frequencies (LSF), Mel-LSP, Reflection Coefficients, Log-Area-Ratio Coefficients, deltas of these, delta-deltas of these, a combination of these, or any other type of spectral parameter. Example aperiodicity parameters may include Mel-Cepstrum, log-aperiodicity-envelope, filterbank-based quantization, maximum voiced frequency, deltas of these, delta-deltas of these, a combination of these, or any other type of aperiodicity parameter. Other parameterizations are possible as well such as maximum voiced frequency or fundamental frequency parameterizations.

Further, in some examples, the speech analysis module 112 may be configured to sample the acoustic feature parameters described above at harmonics/quasi-harmonics of the speech signal, and/or store the samples in the acoustic feature dataset 120. As illustrated in FIG. 1A, the acoustic feature dataset 120 includes phase data 122 and amplitude data 124.

The phase data 122 may be measured at the harmonics/quasi-harmonics of the speech signal by the speech analysis module 112 using various models such as relative phase shift model, harmonic-plus-noise model, adaptive quasi-harmonic-plus-noise model, etc. Further, the speech analysis module 112 may be configured to measure raw phases of the speech signal and/or minimum-phase residual of the speech signal to provide the phase data 122.

The amplitude data 124 may be measured and/or stored using various techniques due to the linear behavior of the amplitude data 124. However, the phase data 122 may require additional processing by the speech analysis module 112 due to the circular (modulo-$2\pi$) nature of the phase data 122. To facilitate statistical processing of the phase data 122, in some examples, the speech analysis module 112 may be configured to align the phase data 122 in an alignment that is invariant to translation. For example, the phase data 122 may be sampled at reference instants of a glottal cycle of the speech signal, such as glottal closure instants. The glottal cycle may correspond to a cyclical series of events in a vocal tract of a speaker articulating the speech signal. For example, the glottal cycle may include the glottal closure instants (e.g., abrupt closure of glottis), pressure build-up instants (e.g., compression of air below vocal folds), blow-out instants (e.g., vocal cords blown apart due to pressure of compressed air). Other examples for the alignment by the speech analysis module 112 are possible as well, such as sampling the phase data 122 at peaks of an excitation signal of the speech signal, points of maximum phase continuity, etc. Further, for example, the phase data 122 may be measured using a model such as the relative phase shift model to facilitate the alignment by the speech analysis module 112.

Therefore, in some examples, the speech analysis module 112 may be configured to determine a circular space (e.g., $[0, 2\pi]$) representation for the phase data 122 by aligning the phase data 122 to a given axis of the circular space representation.

In some examples, the speech analysis module 112 may be configured to provide the acoustic feature parameters for the speech signal (e.g., including the phase data 122 and/or the amplitude data 124) to the acoustic feature dataset 120 as a sequence of speech frames at regular (e.g., 50 Hz, etc.) intervals (e.g., fixed dimensional phase representation). In these examples, the speech analysis module 112 may be configured to resample the phase data 122 at the regular intervals. Various methods for the resampling are possible such as nearest neighbor interpolation, resampling at a unit circle (e.g., circular space representation), resampling after phase unwrapping, etc.

The mapping module 114 may be configured to associate the acoustic feature parameters of the speech signal (e.g., the phase data 122, the amplitude data 124, etc.) with linguistic features in the linguistic feature dataset 130. The linguistic feature dataset 130 may include phonetic features such as phonemes, phones, diphones, triphones, etc.

A phoneme may be considered to be a smallest segment (or a small segment) of an utterance that encompasses a meaningful contrast with other segments of utterances. Thus, a word typically includes one or more phonemes. For example, phonemes may be thought of as utterances of letters; however, some phonemes may represent multiple letters. An example phonemic representation for the English language pronunciation of the word "cat" may be /k/ /ae/ /t/, including the phonemes /k/, /ae/, and /t/ from the English language. In another example, the phonemic representation for the word "dog" in the English language may be /d/ /aw/ /g/, including the phonemes /d/, /aw/, and /g/ from the English language.

Different phonemic alphabets exist, and these alphabets may have different textual representations for the various phonemes therein. For example, the letter "a" in the English language may be represented by the phoneme /ae/ for the sound in "cat," by the phoneme /ey/ for the sound in "ate," and by the phoneme /ah/ for the sound in "beta." Other phonemic representations are possible. As an example, in the English language, common phonemic alphabets may contain about 40 distinct phonemes. In some examples, a phone may correspond to a speech sound. For example, the letter "s" in the word "nods" may correspond to the phoneme /z/ which corresponds to the phone [s] or the phone [z] depending on a position of the word "nods" in a sentence or on a pronunciation of a speaker of the word. In some examples, a sequence of two phonemes (e.g., /k/ /ae/) may be described as a diphone. In this example, a first half of the diphone may correspond to a first phoneme of the two phonemes (e.g., /k/), and a second half of the diphone may correspond to a second phoneme of the two phonemes (e.g., /ae/). Similarly, in some examples, a sequence of three phonemes may be described as a triphone.

Additionally, in some examples, the linguistic features in the linguistic feature dataset 130 may include context features such as prosodic context, preceding and following phonemes, position of speech sound in syllable, position of syllable in word and/or phrase, position of word in phrase, stress/accent/length features of current/preceding/following syllables, distance from stressed/accented syllable, length of current/preceding/following phrase, end tone of phrase, length of speech sound within the speech signal, etc. By way of example, a pronunciation of the phoneme /ae/ in the word "cat" may be different than a corresponding pronunciation of the phoneme /ae/ in the word "catapult," and in turn, may be associated with different acoustic feature parameters (e.g., the phase data 122, the amplitude data 124).

Accordingly, in some examples, the mapping module 114 may be configured to associate the acoustic feature parameters (e.g., the phase data 122) of the input speech signal with various phonetic features and/or context features in the linguistic feature dataset 130.

In some examples, the mapping module 114 may be configured to associate the acoustic feature parameters in the acoustic feature dataset 120 with the linguistic features in the linguistic feature dataset 130 via a statistical mapping process. By way of example, the mapping module 114 may determine a hidden Markov model (HMM) chain that corresponds to the acoustic feature parameters (e.g., the phase data 122 and/or the amplitude data 124) of the input speech signal. For example, an HMM may model a system such as a Markov process with unobserved (i.e., hidden) states. Each HMM state may be represented as a multivariate Gaussian distribution, a multivariate von Mises distribution, or any other multivariate statistical distribution that characterizes statistical behavior of the state. For example, a statistical distribution may include the acoustic feature parameters (e.g., the phase data 122, the amplitude data 124, etc.) matched with one or more linguistic features (e.g., phoneme, etc.) of the linguistic feature dataset 130. Additionally, each state may also be associated with one or more state transitions that specify a probability of making a transition from a current state to another state (e.g., based on context features, etc.). Thus, the mapping module 114 may determine an HMM chain that corresponds to the linguistic content indicated by the linguistic features.

When applied to the device 100, in some examples, the combination of the multivariate statistical distributions and the state transitions for each state may define a sequence of acoustic feature parameters corresponding to the input speech signal. In one example, where the speech analysis module 112 provides the acoustic feature parameters as a sequence of speech frames, the HMM may model one speech frame of the sequence. In another example, the HMM may model a pronunciation of a linguistic feature (e.g., phoneme) that takes into account context of the linguistic feature (e.g., preceding/following phonemes, etc.) when mapping the acoustic feature parameters to the linguistic feature.

For the amplitude data 124, for example, the statistical mapping process may be performed via any suitable model such as regression, Hidden Markov Models (HMM), Deep Neural Networks (DNN), etc., based on the amplitude data 124 being represented in a linear space (e.g., $[-\infty, \infty]$). However, for the phase data 122, a different procedure may be employed by the mapping module 114 to accommodate the circular nature (modulo-$2\pi$) of the phase data 122.

In one example, the mapping module 114 may perform a regression (e.g., linear regression, non-linear regression, etc.) based on the phase data 122 being represented in the circular space representation described in the speech analysis module 112 to provide phase vectors for the linguistic features of the linguistic feature dataset 130.

In another example, the mapping module 144 may be configured to provide probability density functions (pdfs) of phase based on associating the phase data 122 with one or more statistical models adapted in accordance with the circular space. For example, a linear statistical distribution pdf (e.g., Gaussian distribution pdf, etc.) may define a distribution over a linear space (e.g., $[-\infty, \infty]$). In accordance with the present disclosure, such distribution may be adapted over a circular space (e.g., $[0, 2\pi]$), for example, by mapping the linear distribution to a unit circle. For example, rather than the standard statistical distribution pdf, a wrapped statistical distribution pdf having the circular space may be utilized for representing the phase data 122. Further, in some examples, one or more statistical distributions such as von Mises distributions may already be mapped to a unit circle (e.g., circular space) and may therefore be utilized in accordance with the present disclosure for providing pdfs of phase.

Accordingly, in some examples, the one or more statistical models may include a wrapped Gaussian Mixture Model (GMM), a wrapped Gaussian pdf, a Mixture of von Mises pdf, a von Mises pdf, a decision tree-clustered wrapped GMM, a decision tree-clustered wrapped Gaussian, a decision tree-clustered mixture von Mises pdf, a decision tree-clustered von Mises pdf, a neural network, a mixture density network, a recurrent neural network, a long short-term memory, or any other statistical model adapted in accordance with the circular space representation for the phase data 122.

An example wrapped GMM implementation of the mapping module 114 for the statistical mapping is as follows. The mapping module 114 may determine a mean of a mixture component with a largest (or threshold) mixture weight of the GMM. The mapping module 114 may then determine an optimal sequence of Gaussian pdfs according to particular criteria such as smoothness or likelihood. In turn, mean vectors of the optimal sequence may be determined. The mapping module 114 may then utilize a speech parameter generation algorithm with the mixture components to identify a phase vector sequence in accordance with various conditions. A first example condition may include maximizing an output probability given the mixture components under a relationship between static and dynamic features. A second example condition may include maximizing a joint probability of mixture components and phase vector sequence under the relationship between static and dynamic features. A third example condition may include maximizing the output probability under the relationship between static and dynamic features while marginalizing mixture components as hidden variables. An example mixture von Mises pdf implementation may be similar to the wrapped GMM implementation except von Mises multivariate distributions may be utilized instead of wrapped Gaussian multivariate distributions.

An example wrapped Gaussian pdf implementation of the mapping module 114 for the statistical mapping is as follows. The mean vector of the wrapped Gaussians pdfs may be determined similarly to the wrapped GMM implementation. The mapping module 114 may then utilize the speech parameter generation algorithm to identify the phase vector sequence that maximizes the output probability given the wrapped Gaussian pdfs under the relationship between static and dynamic features. An example von Mises pdf implementation may be similar to the wrapped Gaussian pdf implementation except von Mises distributions may be utilized instead of wrapped Gaussian distributions.

An example for decision-tree based implementations (e.g., decision tree-clustered wrapped GMM, decision tree-clustered wrapped Gaussian, decision tree-clustered mixture von Mises pdf, decision tree-clustered von-Mises pdf) of the mapping module 114 for the statistical mapping is as follows. A decision tree may be configured to map an input space (e.g., the linguistic features) to an output space (e.g., phase vectors). At a given node of the decision tree may indicate a wrapped GMM, wrapped Gaussian, mixture of von Mises pdfs, von Mises pdfs, etc. In turn, the phase vectors may be determined based on a search of the decision tree (e.g., based on smoothness, likelihood etc.).

An example for neural network implementations and variants of neural networks (e.g., mixture density network, recurrent neural network, long short-term memory, etc.) of the mapping module 114 for the statistical mapping is as follows. The neural network may be configured to learn mapping from an input sequence (e.g., linguistic features) to output sequence (e.g., phase vectors). The neural network may then be trained based on the phase data 122, while using the statistical distributions adapted for the circular space (e.g., wrapped Gaussian pdf, wrapped GMM, mixture of von Mises pdfs, von Mises distributions, etc.) as the output distribution of the neural network. For example, parameters of the statistical distributions may correspond to outputs of the neural network, and weights of the neural network may be trained based on an error measure associated with the statistical distributions. In turn, the input sequence of the neural network may be mapped to pdfs of the output space, and the phase vectors for the input speech signal may be generated by the mapping module 114 based on such map.

The speech synthesis module 116 may be configured to receive a parametric representation of linguistic content (e.g., text, etc.) based on the mapping performed by the mapping module 114. The parametric representation may include amplitude information and phase information. It is noted that the phase information is based on the phase data 122, which in turn, is based on measured phase values by the speech analysis module 112. The speech synthesis module 116 may provide the program instructions 110 executable by the processor 106 to cause the device 100 to provide an output (e.g., via the output interface 104) indicative of a synthetic audio pronunciation of the linguistic content.

In some examples, functions of the speech synthesis module 116 may be performed based on a modification of a vocoder synthesis system. Example vocoder synthesis systems that may be modified by the speech synthesis module 116 may include sinusoidal vocoders (e.g., AhoCoder, Harmonic-plus-Noise Model (HNM) vocoder, Sinusoidal Transform Codec (STC), etc.) and/or non-sinusoidal vocoders (e.g., STRAIGHT, etc.). The example vocoder synthesis systems above may model phase data based on physiologically inspired phase models. Accordingly, in some examples, the speech synthesis module 116 may be configured to modify such vocoder synthesis systems to utilize the phase information of the parametric representation received from the mapping module 114 instead of the phase models utilized by the vocoder synthesis systems. Therefore, in some examples, the device 100 may be configured to provide synthetic speech that is based on measured phase data (e.g., the phase data 122) and measured amplitude data (e.g., the amplitude data 124), in accordance with data-driven (e.g., deterministic, etc.) statistical models of the mapping module 114.

Figure 1B:
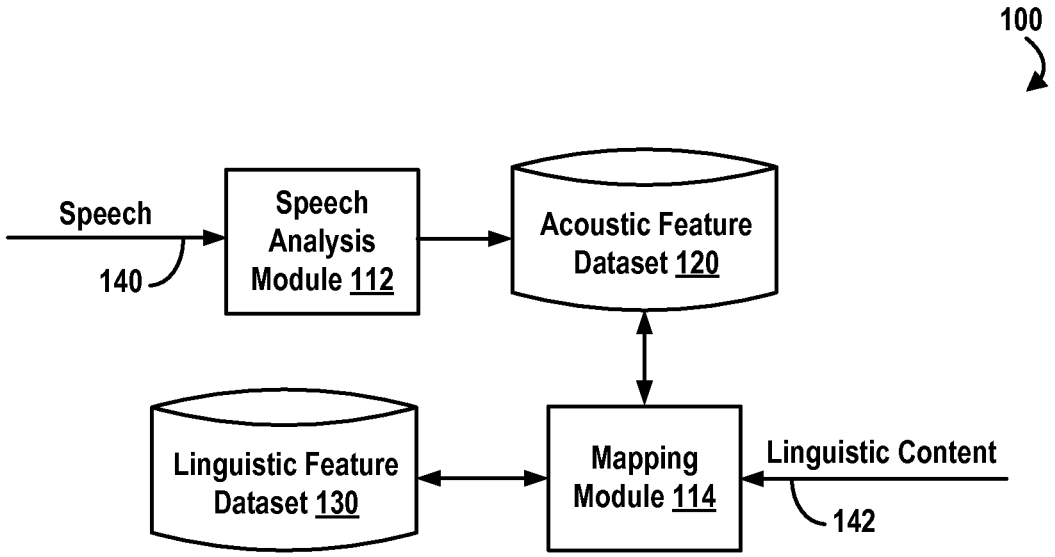
FIGS. 1B-1E illustrate example operations of the example device of FIG. 1A, in accordance with at least some embodiments described herein.

FIGS. 1B-1E illustrate example operations of the example device 100 of FIG. 1A, in accordance with at least some embodiments described herein. In FIG. 1B, the device 100 may be configured to receive inputs including speech 140 and linguistic content 142 (e.g., text). The inputs, for example, may be received via the input interface 102 (not shown in FIG. 1B). In some examples, the speech 140 may correspond to a pronunciation of the linguistic content 142. Accordingly, FIG. 1B may illustrate a "training" operation of the device 100. For example, in FIG. 1B, the speech analysis module 112 may determine the acoustic feature parameters for the speech 140 including the phase data 122 and the amplitude data 124 (not shown in FIG. 1B), to generate and/or modify the acoustic feature dataset 120. Further, in FIG. 1B, the mapping module 114 may receive the linguistic content 142 and identify the linguistic features (e.g., phonemes, etc.) in the linguistic dataset 130 associated with the linguistic content 142. Further, in FIG. 1B, the mapping module 114 may associate the identified linguistic features with the acoustic feature parameters of the speech 140 for later processing in accordance with the description in FIG. 1A.

Figure 1C:
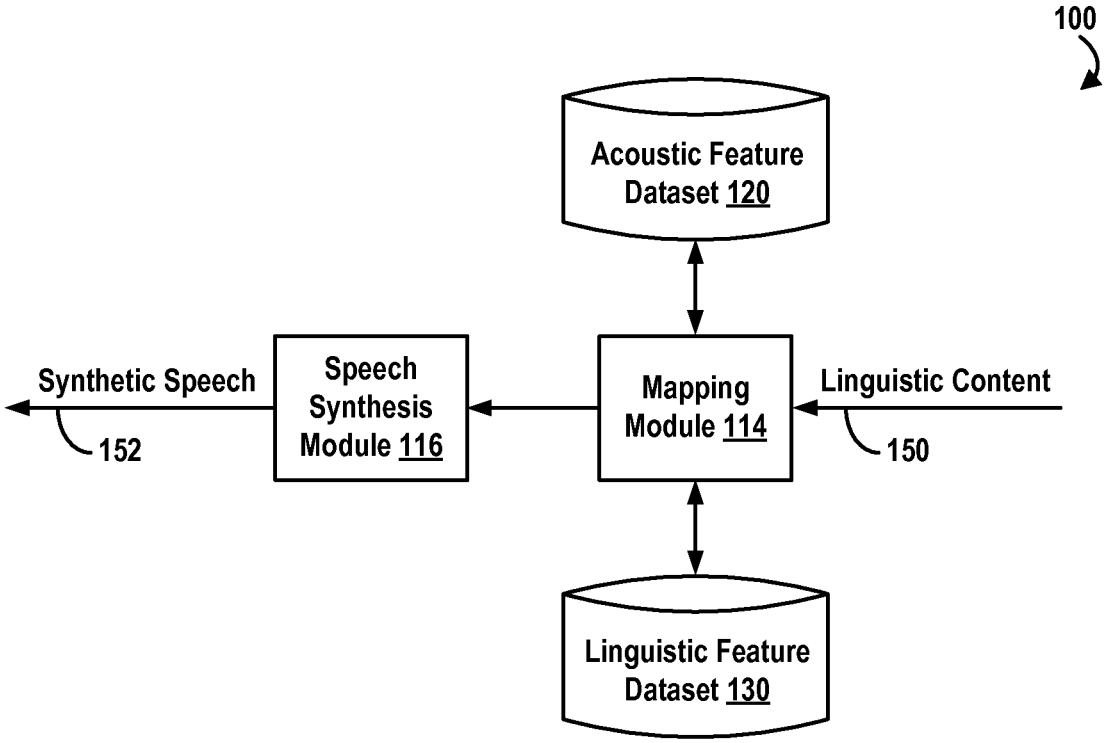

In FIG. 1C, the device 100 may be configured to receive an input including linguistic content 150 (e.g., text). The input, for example, may be received via the input interface 102 (not shown in FIG. 1C). In some examples, the device 100 in FIG. 1C may be configured to provide an output that includes synthetic speech 152 indicative of a synthetic audio pronunciation of the linguistic content 150. The output, for example, may be provided via the output interface 104 (not shown in FIG. 1C). Accordingly, FIG. 1C may illustrate a "speech synthesis" (e.g., TTS) operation of the device 100. By way of example, in FIG. 1C, the mapping module 114 may perform the statistical mapping described in FIG. 1A based on the acoustic feature dataset 120 and the linguistic feature dataset 130 (e.g., determined via the "training" operation of FIG. 1B). Thus, for example, the mapping module 114 may provide an acoustic feature representation for the linguistic content 150 that includes amplitude information and phase information to the speech synthesis module 116. For example, the mapping module 114 may provide a sequence of speech frames, where a given speech frame includes acoustic feature parameters based on the acoustic feature dataset 120 (e.g., based on the phase data 122, etc.) that correspond to a pronunciation of a portion of the linguistic content 150. In the example, the speech synthesis module 116 may receive the sequence of speech frames and provide the synthetic speech 152 in accordance with the description of FIG. 1A.

Figure 1D:
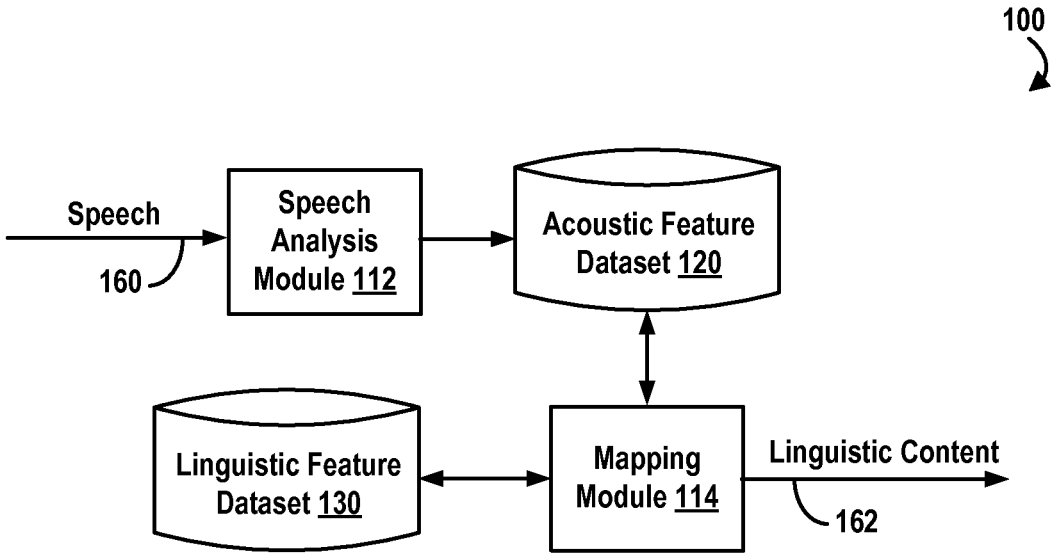

In FIG. 1D, the device 100 may be configured to receive an input including speech 160. The input, for example, may be received via the input interface 102 (not shown in FIG. 1D). In some examples, the device 100 in FIG. 1D may be configured to provide an output that includes linguistic content 162 that may correspond to a textual representation of the speech 160. The output, for example, may be provided via the output interface 104 (not shown in FIG. 1D). Accordingly, FIG. 1D may illustrate a "speech recognition" (e.g., ASR) operation of the device 100. By way of example, in FIG. 1D, the speech analysis module 112 may determine acoustic feature parameters for the speech 160 for inclusion in the acoustic feature dataset 120 (e.g., phase data 122, amplitude data 124). Further, for example, the mapping module 114 may perform the statistical mapping described in FIG. 1A based on the acoustic feature dataset 120 and the linguistic feature dataset 130 (e.g., determined via the "training" operation of FIG. 1B). In turn, the mapping module 114 may identify the linguistic content 162 associated with the speech 160 (e.g., identify phonemic representation and/or textual representation). It is noted that the mapping by the mapping module 114 in FIG. 1D incorporates the measured phase data (e.g., phase data 122), and thus allows for enhanced accuracy pertaining to the identification of the linguistic content 162.

Figure 1E:
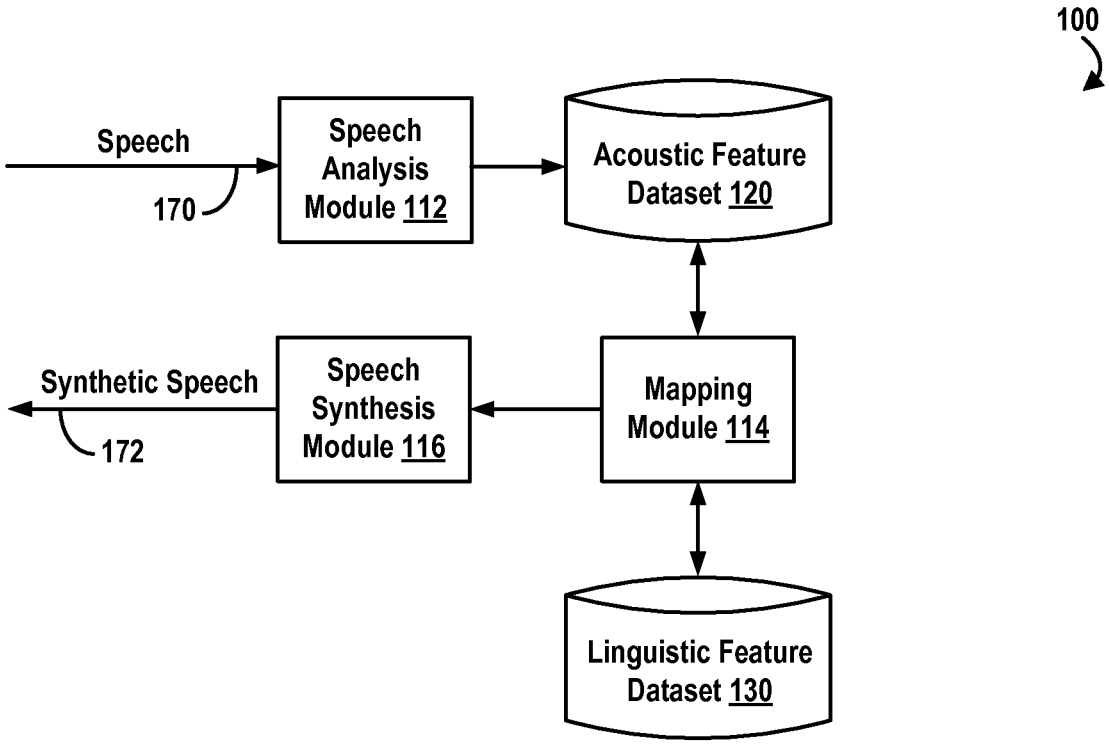

In FIG. 1E, the device 100 may be configured to receive an input including speech 170. The input, for example, may be received via the input interface 102 (not shown in FIG. 1E). In some examples, the device 100 in FIG. 1E may be configured to provide an output that includes synthetic speech 172 that may correspond to a synthetic audio pronunciation of the speech 170. The output, for example, may be provided via the output interface 104 (not shown in FIG. 1E). Accordingly, FIG. 1E may illustrate a "speech restoration" operation of the device 100. For example, the speech 170 may include low quality speech content (e.g., noisy, etc.), and the synthetic speech 172 may therefore include higher quality speech content. By way of example, in FIG. 1E, the speech analysis module 112 may determine acoustic feature parameters for the speech 170 for inclusion in the acoustic feature dataset 120 (e.g., phase data 122, amplitude data 124). Further, for example, the mapping module 114 may perform the statistical mapping described in FIG. 1A based on the acoustic feature dataset 120 and the linguistic feature dataset 130 (e.g., determined via the "training" operation of FIG. 1B). In turn, the mapping module 114 may identify linguistic content (e.g., phonemic representation, etc.) associated with the speech 160. It is noted that the mapping by the mapping module 114 in FIG. 1E incorporates the measured phase data (e.g., phase data 122), and thus allows for enhanced accuracy pertaining to the identification of the linguistic content. Further, the mapping module 114 may provide a parametric representation of the linguistic content based on data from the acoustic feature dataset 120. The data, for example, may include acoustic feature parameters for higher-quality speech sounds that correspond to a pronunciation of the linguistic content, or for speech sounds having different voice characteristics (e.g., speech sounds from another speaker). The speech synthesis module 116 in FIG. 1E may then process the parametric representation in accordance with the description in FIG. 1A to provide the synthetic speech 172.

It is noted that functional blocks of FIGS. 1A-1E are illustrated for convenience in description. In some embodiments, the device 100 may be implemented using more or less components configured to perform the functionalities described in FIGS. 1A-1E. For example, the speech analysis module 112, the mapping module 114, and/or the speech synthesis module 116 may be implemented as one, two, or more software components. Further, in some examples, components of the device 100 may be physically implemented in one or more computing devices according to various applications. In one example, a training computing device may include the speech analysis module 112 and the mapping module 114. In another example, a speech synthesis computing device may include the mapping module 114 and the speech synthesis module 116. In yet another example, a storage computing device (e.g., server) may include the acoustic feature dataset 120 and/or the linguistic feature dataset 130, and may be accessible by the device 100, the training computing device, and/or the synthesis computing device. Other configurations and combinations are possible as well.

Figure 2A:
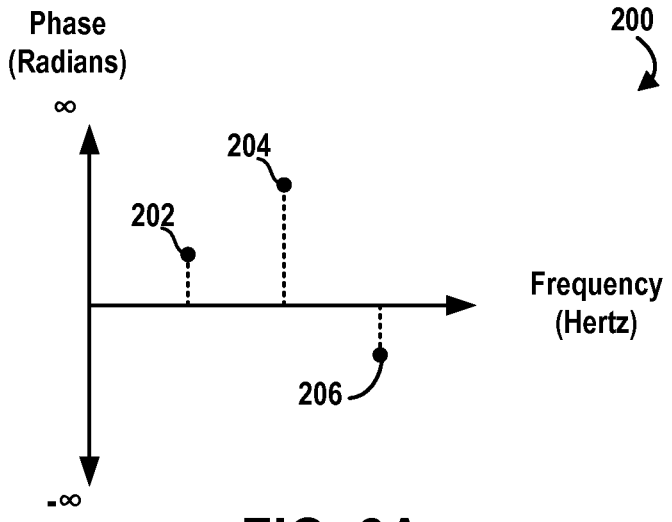
FIGS. 2A-2C illustrate example representations of phase data, in accordance with at least some embodiments described herein.
Figure 2B:
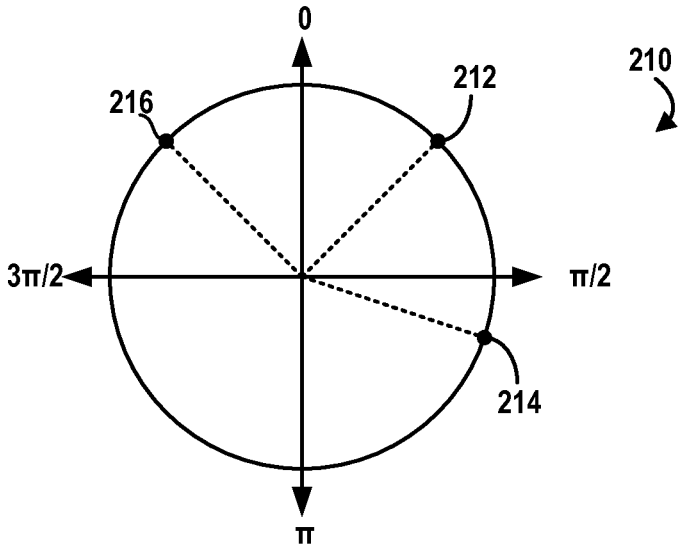
Figure 2C:
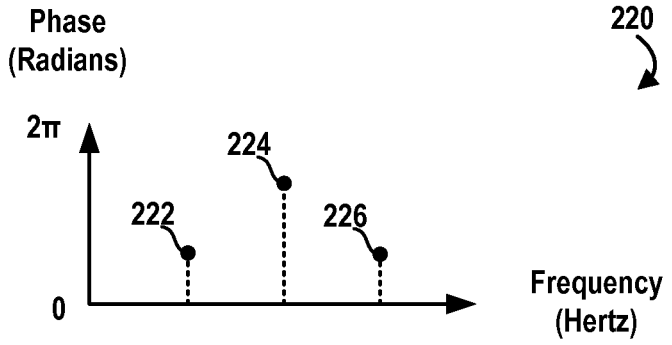

FIGS. 2A-2C illustrate example representations of phase data, in accordance with at least some embodiments described herein. FIG. 2A illustrates a representation 200 of phase data similar to the phase data 122 of FIG. 1A. For example, the horizontal axis of FIG. 2A may correspond to harmonic frequencies of a speech frame (e.g., the acoustic feature parameters of speech at a given time). Accordingly, the phase data may include phase values 202-204 measured at the harmonic frequencies. For example, the phase value 202 may correspond to a phase value of $\pi/4$ at the harmonic frequency of 1450 Hz, the phase value 204 may correspond to a phase value of $5\pi/8$ at the harmonic frequency of 1600 Hz, and the phase value 206 may correspond to a phase value of $-\pi/4$ at the harmonic frequency of 1750 Hz. The vertical axis of FIG. 2A, for example, may correspond to the example values described above. Further, as illustrated in FIG. 2A, the vertical axis may correspond to a linear space that spans a range $[-\infty, \infty]$. In some examples, amplitude data (e.g., amplitude data 124 of FIG. 1A) may be similarly measured at the same harmonic frequencies of the phase values 202-206.

FIG. 2B illustrates a circular space representation 210 of the phase data in FIG. 2A. As illustrated in FIG. 2B, for example, the phase values 202-206 of FIG. 2A are mapped, respectively, to phase values 212-216 of FIG. 2B at varying angles between the vertical and horizontal axes of FIG. 2B. For example, where the phase value 206 corresponds to $-\pi/4$, the phase value 216 may correspond to ($-\pi/4$ mod $2\pi=3\pi/4$), etc. In turn, the phase values 212-216 may be aligned with a given axis (e.g., vertical axis, horizontal axis, etc.) of the circular space representation 210 to accommodate the modulo-$2\pi$ behavior of the phase data.

FIG. 2C illustrates a representation 220 of phase values 222-226 mapped to harmonic frequencies of the speech (e.g., the harmonic frequencies of FIG. 2A). For example, the phase values 222-226 of FIG. 2C may correspond, respectively, to the phase values 212-216 of FIG. 2B mapped to the harmonic frequencies of the speech frame similarly to the phase values 202-206 of FIG. 2A. As illustrated in FIG. 2C, the horizontal axis may correspond to the harmonic frequencies in Hertz similarly to the horizontal axis of FIG. 2A. Further, as illustrated in FIG. 2C, the vertical axis correspond to the phase values 222-226 in the circular space having the range $[0, 2\pi]$. In turn, for example, statistical processing of the phase data (e.g., the phase values 222-226) may be performed in accordance with the description of the mapping module 114 of FIGS. 1A-1E.

Figure 3:
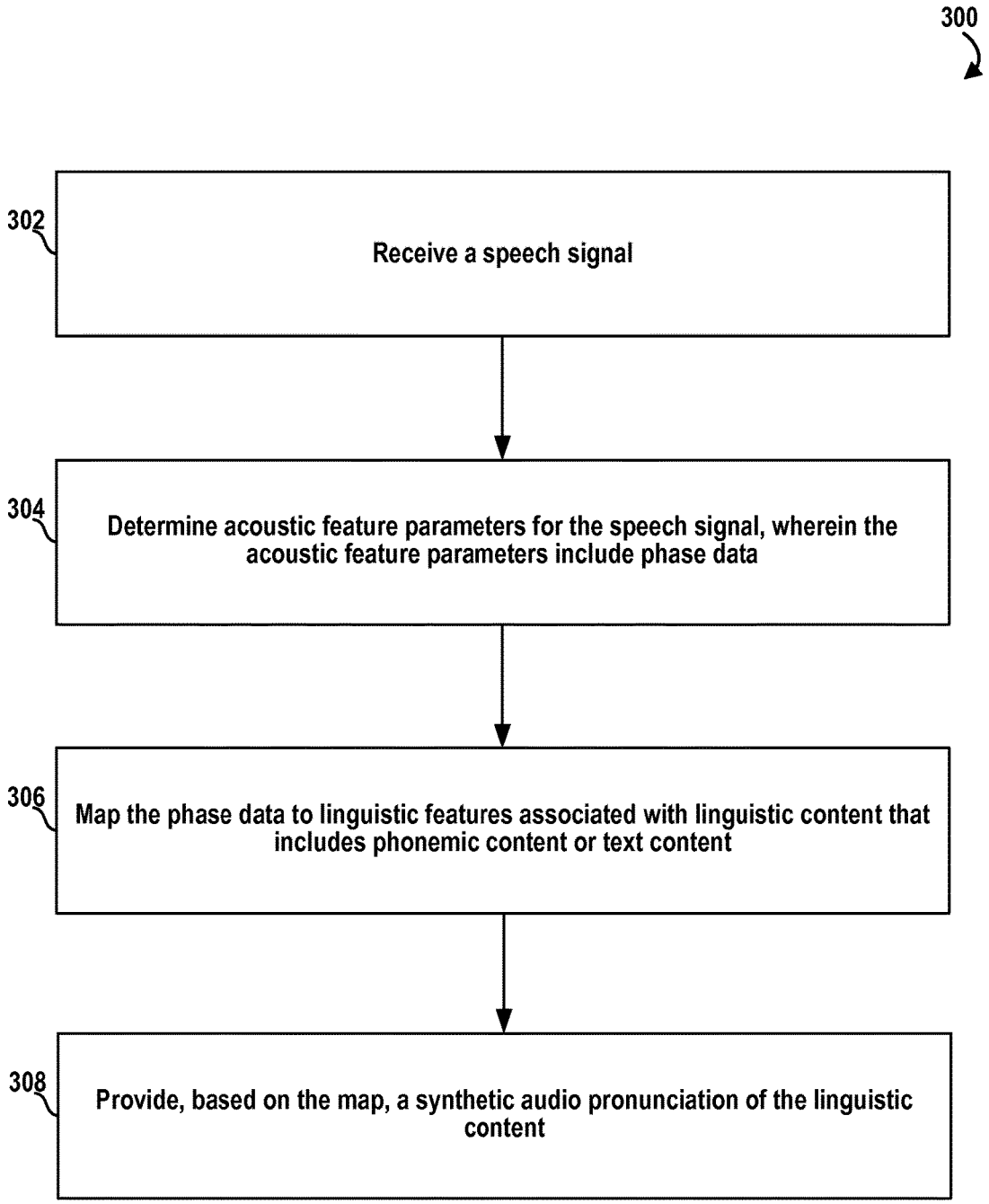
FIG. 3 is a block diagram of an example method, in accordance with at least some embodiments described herein.

FIG. 3 is a block diagram of an example method 300, in accordance with at least some embodiments described herein. Method 300 shown in FIG. 3 presents an embodiment of a method that could be used with the device 100, for example. Method 300 may include one or more operations, functions, or actions as illustrated by one or more of blocks 302-308. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In addition, for the method 300 and other processes and methods disclosed herein, the flowchart shows functionality and operation of one possible implementation of present embodiments. In this regard, each block may represent a module, a segment, a portion of a manufacturing or operation process, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

In some examples, for the method 300 and other processes and methods disclosed herein, each block may represent circuitry that is wired to perform the specific logical functions in the process.

At block 302, the method 300 includes receiving a speech signal. The speech signal may be similar to the inputs 140, 160, and/or 170, of the FIGS. 1B-1E. For example, a device that includes one or more processors may receive the speech signal via an input interface similar to the input interface 102 of the device 100.

At block 304, the method 300 includes determining acoustic feature parameters for the speech signal. The acoustic feature parameters may include phase data. The acoustic feature parameters may be determined similarly to the acoustic feature dataset 120 determined by the speech analysis module 112. For example, the phase data may be based on measured phase values at harmonic frequencies and/or quasi-harmonics of the speech signal.

Further, in some examples, the method 300 may include determining the phase data based on the phase data being associated with reference time-instants of a glottal cycle in the speech signal. For example, similarly to the speech analysis module 112, the reference time-instances may correspond to glottal closure time-instants.

Further, in some examples, the method 300 may include determining circular space representations for the phase data based on an alignment of the phase data with given axes of the circular space representations. For example, a given circular space representation may correspond to a unit circle (e.g., [0, 2π] space) and the phase data may be associated with a distance from an origin axis of the unit circle. Thus, in some examples, the method 300 may include aligning the phase data such that the phase data is invariant to translation to facilitate statistical speech processing of the phase data.

At block 306, the method 300 includes mapping the phase data to linguistic features associated with linguistic content that includes phonemic content or text content. In some examples, the mapping may be based on the circular space representations of the phase data. The mapping at block 306 may be similar to functions of the mapping module 114 of the device 100. For example, the mapping may include associating the phase data with one or more statistical models having a circular space. In one example, a regression may be performed to associate the phase data with the linguistic features based on the phase data having the circular space representations. In another example, a Gaussian distribution or any other statistical distribution may be adapted to have a circular space (e.g., wrapped Gaussian pdf, wrapped GMM, etc.) and utilized as a representation for the phase data, and a sequence of such wrapped Gaussian pdfs may be determined to correspond to a maximum likelihood of characterizing the speech.

In some examples, the one or more statistical models may include one or more of a wrapped Gaussian Mixture Model (GMM), a wrapped Gaussian Probability Density Function (pdf), a Mixture von Mises pdf, a von Mises pdf, a decision tree-clustered wrapped GMM, a decision tree-clustered wrapped Gaussian, a decision tree-clustered mixture von Mises pdf, a decision tree-clustered von Mises pdf, a neural network, a mixture density network, a recurrent neural network, or a long short-term memory, similarly to the description of the mapping module 114 of the device 100.

At block 308, the method 300 includes providing a synthetic audio pronunciation of the linguistic content based on the mapping. The provision of the synthetic audio pronunciation may be similar to the provision described for the speech synthesis module 116 of the device 100. For example, the synthetic audio pronunciation may be based on a parametric representation that includes amplitude information and phase information. The phase information, in this example, may be based on the phase data determined at block 304, which in turn may be based on measured phase values of acoustic features in the speech signal.

In some examples, the method 300 may include providing the phase data to a vocoder synthesis system. In these examples, providing the output may be based on providing the phase data. For example, a sinusoidal vocoder (e.g., AhoCoder, HNM, STC, etc.) or a non-sinusoidal vocoder (e.g., STRAIGHT, etc.) may be modified by the method 300 to utilize the phase data from block 304, similarly to the modification described for the speech synthesis module 116 of the device 100.

Figure 4:
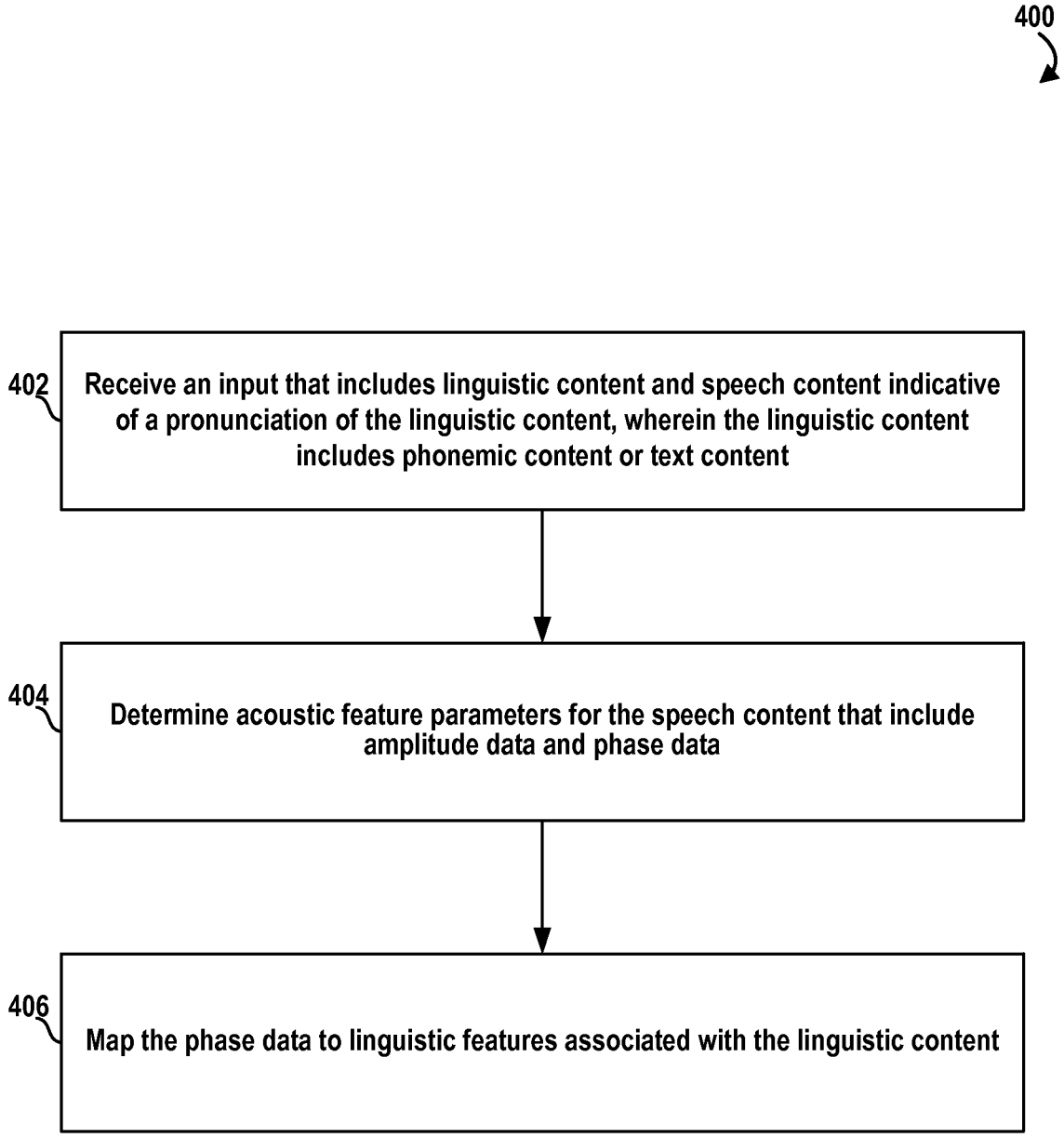
FIG. 4 is a block diagram of an example method, in accordance with at least some embodiments described herein.

FIG. 4 is a block diagram of an example method 400, in accordance with at least some embodiments described herein. Method 400 shown in FIG. 4 presents an embodiment of a method that could be used with the device 100, for example. Method 400 may include one or more operations, functions, or actions as illustrated by one or more of blocks 402-406. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 402, the method 400 includes receiving an input that includes linguistic content and speech content indicative of a pronunciation of the linguistic content. The linguistic content may include phonemic content or text content. The linguistic content and the speech content may be similar, respectively, to the linguistic content 142 and the speech 140 of FIG. 1B.

At block 404, the method 400 includes determining acoustic feature parameters for the speech content that include amplitude data and phase data. The acoustic feature parameters may be determined similarly to the acoustic feature dataset 120 determined by the speech analysis module 112 of FIG. 1B. For example, the phase data may be based on measured phase values at harmonic frequencies and/or quasi-harmonics of the speech. Further, for example, the phase data may be aligned with a circular space representation suitable for statistical speech processing.

At block 406, the method 400 includes mapping the phase data to linguistic features associated with the linguistic content. Thus, in some examples, the method 400 may provide the "training" operation of the device 100 described in FIG. 1B. For example, the method 400 may include generating and/or updating the acoustic feature dataset 120 to include the acoustic feature parameters of the speech including amplitude data and phase data, and mapping the acoustic feature parameters to linguistic features similarly to operation of the mapping module 114 in FIG. 1B.

Figure 5:
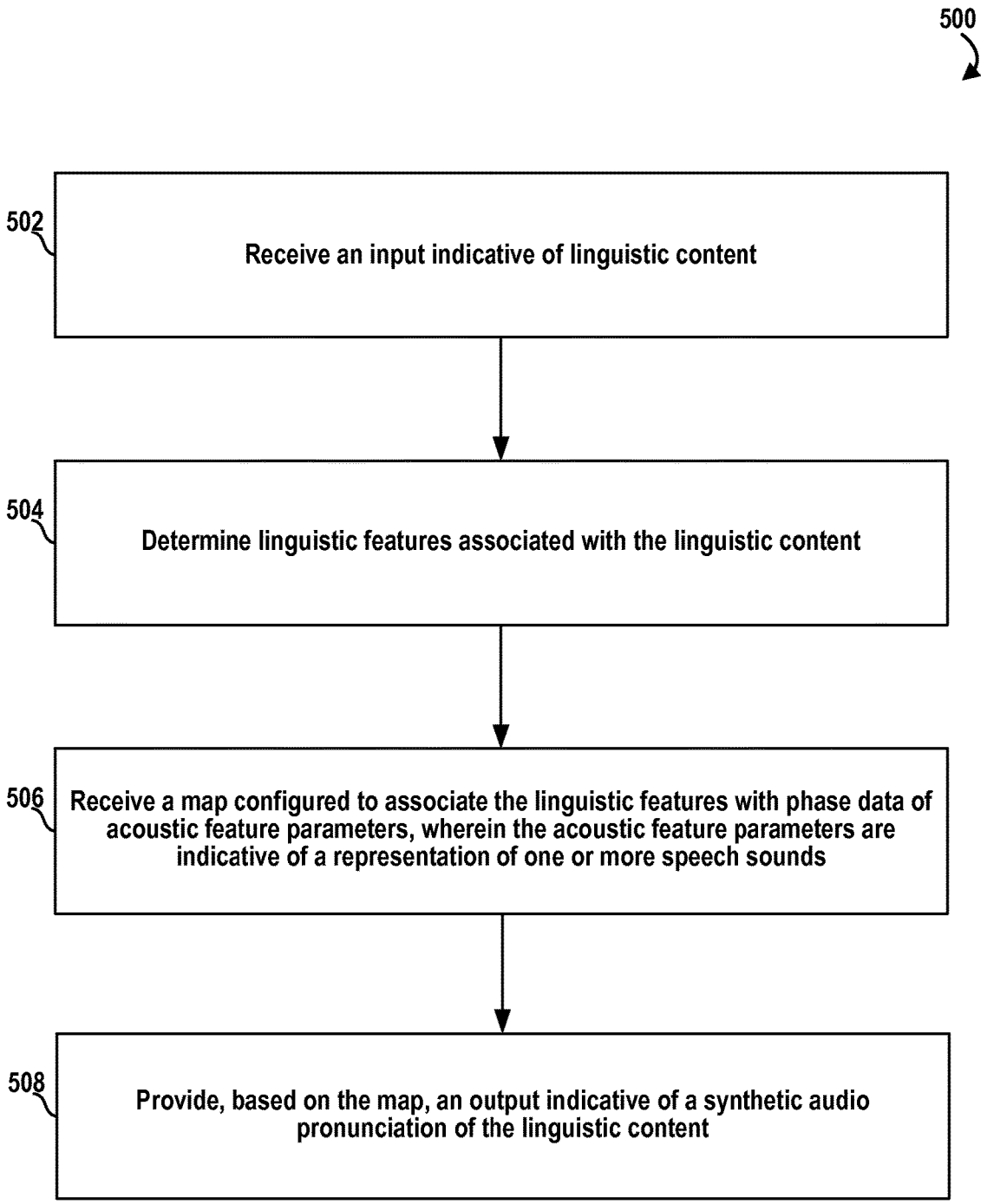
FIG. 5 is a block diagram of an example method, in accordance with at least some embodiments described herein.

FIG. 5 is a block diagram of an example method 500, in accordance with at least some embodiments described herein. Method 500 shown in FIG. 4 presents an embodiment of a method that could be used with the device 100, for example. Method 500 may include one or more operations, functions, or actions as illustrated by one or more of blocks 502-508. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 502, the method 500 includes receiving an input indicative of linguistic content. The linguistic content may be similar to the linguistic content 150 of FIG. 1C.

At block 504, the method 500 includes determining linguistic features associated with the linguistic content. For example, the method 500 may determine a phonemic representation (linguistic features) of the linguistic content that includes a sequence of one or more phonemes. Further, for example, the linguistic features may include context features as well, such as features associated with preceding/following phonemes or other prosodic context of the linguistic content.

At block 506, the method 500 includes receiving a map configured to associate the linguistic features with phase data of acoustic feature parameters. The acoustic feature parameters may be indicative of a representation of one or more speech sounds. For example, block 506 may perform functions of the mapping module 114 in FIG. 1C to provide a parametric acoustic feature representation of a pronunciation of the linguistic content. For example, the map received at block 506 may be based on output of the mapping module 114 (e.g., identifying a sequence of speech frames from within the acoustic feature dataset 120 that correspond to the acoustic feature parameters as described in the FIG. 1C). For the phase data, for example, the map may be based on statistical models (e.g., wrapped GMM, etc.) that have a circular space suitable for the modulo-$2\pi$ nature of the phase data.

At block 508, the method 500 includes providing an output indicative of a synthetic audio pronunciation of the linguistic content based on the map. The provision of the output at block 508 may be similar to the provision described for the speech synthesis module 116 of FIG. 1C. For example, the synthetic audio pronunciation may be based on the parametric representation that includes amplitude information and phase information. The phase information, in this example, may be based on the phase data determined at block 506, which in turn may be based on measured phase values of acoustic features in the speech. Accordingly, in some examples, the method 500 may include functions of the "speech synthesis" operation of the device 100 described in FIG. 1C.

Figure 6:
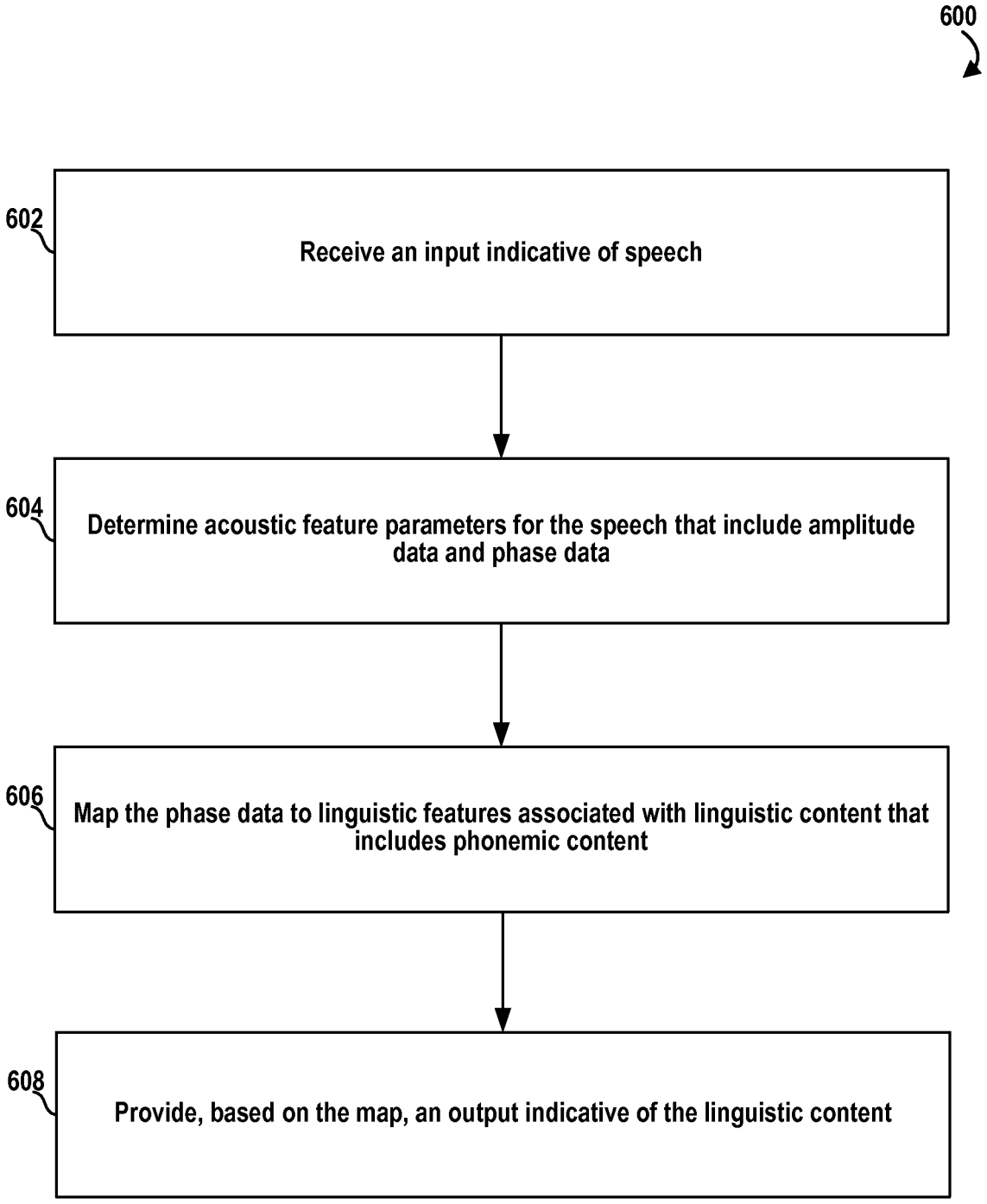
FIG. 6 is a block diagram of an example method, in accordance with at least some embodiments described herein.

FIG. 6 is a block diagram of an example method 600, in accordance with at least some embodiments described herein. Method 600 shown in FIG. 6 presents an embodiment of a method that could be used with the device 100, for example. Method 600 may include one or more operations, functions, or actions as illustrated by one or more of blocks 602-608. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 602, the method 600 includes receiving an input indicative of speech. The input may be similar to the speech 160 of FIG. 1D. Further, block 602 may be similar to block 302 of the method 300.

At block 604, the method 600 includes determining acoustic feature parameters for the speech that include amplitude data and phase data, similarly to operation of the speech analysis module 112 of FIG. 1D and/or block 304 of the method 300.

At block 606, the method 600 includes mapping the phase data to linguistic features associated with linguistic content that includes phonemic content. For example, block 606 may be similar to operation of the mapping module 114 in FIG. 1D. By way of example, the method 600 may associate the phase data (and/or the amplitude data) in the acoustic feature parameters with linguistic features such as a phonemic representation of the speech. Identifying such linguistic features may be enhanced by the method 600, for example, due to incorporating the phase data to characterize context features such as prosodic context of the speech.

At block 608, the method 600 includes providing an output indicative of the linguistic content based on the map. The output, for example, may be similar to the linguistic content 162 of FIG. 1D. For example, the method 600 may provide a textual representation of the speech indicated by the input. Accordingly, in some examples, the method 600 may provide the "speech recognition" operation of the device 100 described in FIG. 1D. By incorporating the phase data in statistical speech recognition, for example, the method 600 may enhance accuracy of the identified text.

Figure 7:
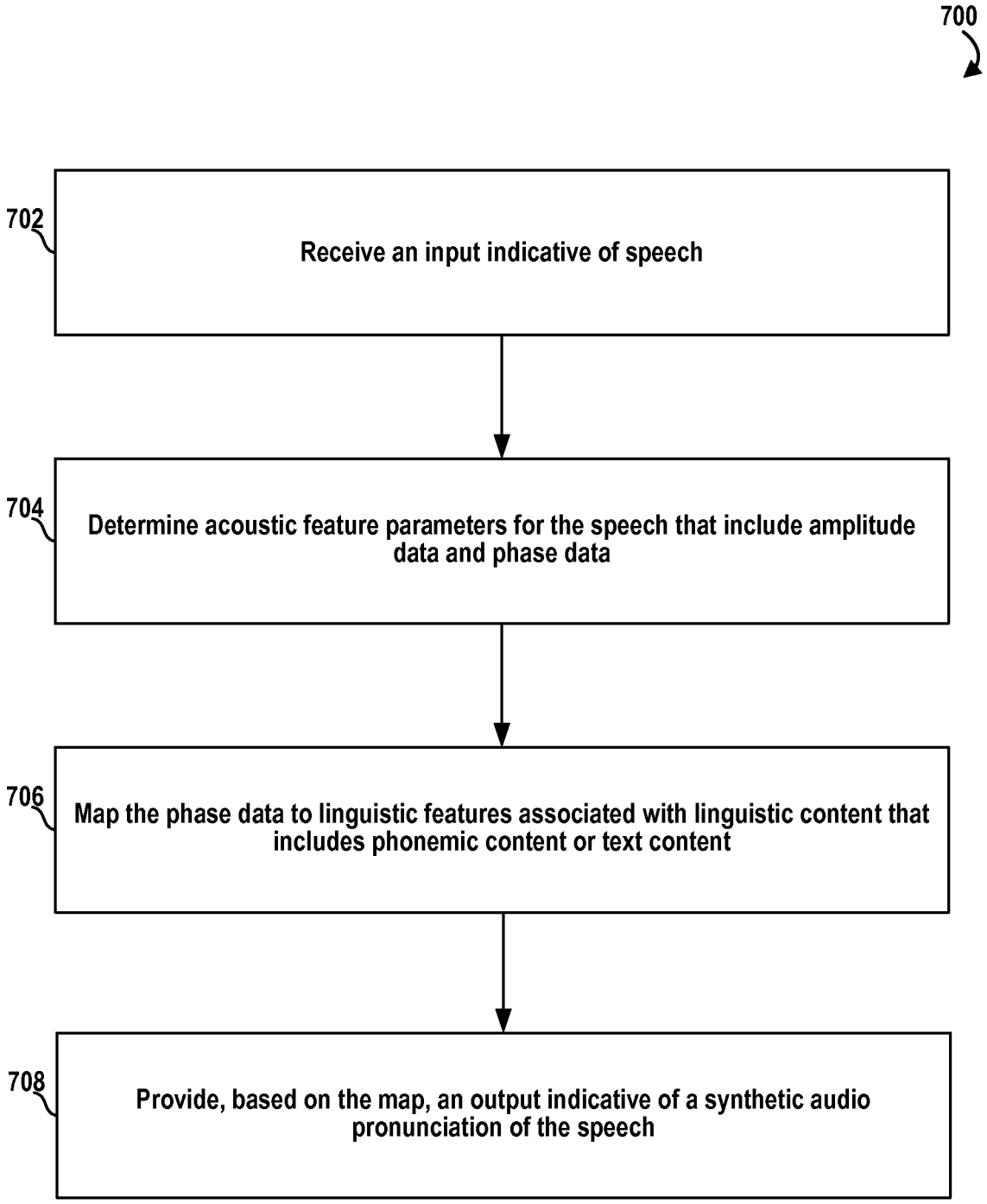
FIG. 7 is a block diagram of an example method, in accordance with at least some embodiments described herein.

FIG. 7 is a block diagram of an example method 700, in accordance with at least some embodiments described herein. Method 700 shown in FIG. 7 presents an embodiment of a method that could be used with the device 100, for example. Method 700 may include one or more operations, functions, or actions as illustrated by one or more of blocks 702-708. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 702, the method 700 includes receiving an input indicative of speech. The input, for example, may be similar to the speech 170 of FIG. 1E. Further, block 702 may be similar to block 302 of the method 300.

At block 704, the method 700 includes determining acoustic feature parameters for the speech that include amplitude data and phase data, similarly to operation of the speech analysis module 112 of FIG. 1E and/or block 304 of the method 300.

At block 706, the method 700 includes mapping the phase data to linguistic features associated with linguistic content that includes phonemic content or text content. For example, block 706 may be similar to operation of the mapping module 114 in FIG. 1E. By way of example, the method 700 may associate the phase data (and/or amplitude data) in the acoustic feature parameters with linguistic features such as a phonemic representation of the speech. Identifying such linguistic features may be enhanced by the method 700, for example, due to incorporating the phase data to characterize context features such as prosodic context of the speech.

At block 708, the method 700 includes providing an output indicative of a synthetic audio pronunciation of the speech based on the mapping. The output, for example, may be similar to the synthetic speech 172 of FIG. 1E. Thus, for example, the method 700 may include determining a phonemic representation (e.g., linguistic features) of the speech in the input, and providing the synthetic audio pronunciation of the speech based on the phonemic representation. In one example, the input speech may include speech by a first speaker, and the output synthesized audio pronunciation may correspond to speech by a second speaker or speech having different voice characteristics that corresponds to the same linguistic content as the input speech. In another example, the input speech may include low quality speech (e.g., noisy, etc.), and the output synthesized audio pronunciation may correspond to higher quality speech based on acoustic feature parameters associated with the higher quality speech. Accordingly, in some examples, the method 700 may perform the "speech restoration" operation of the device 100 described in FIG. 1E.

Figure 8:
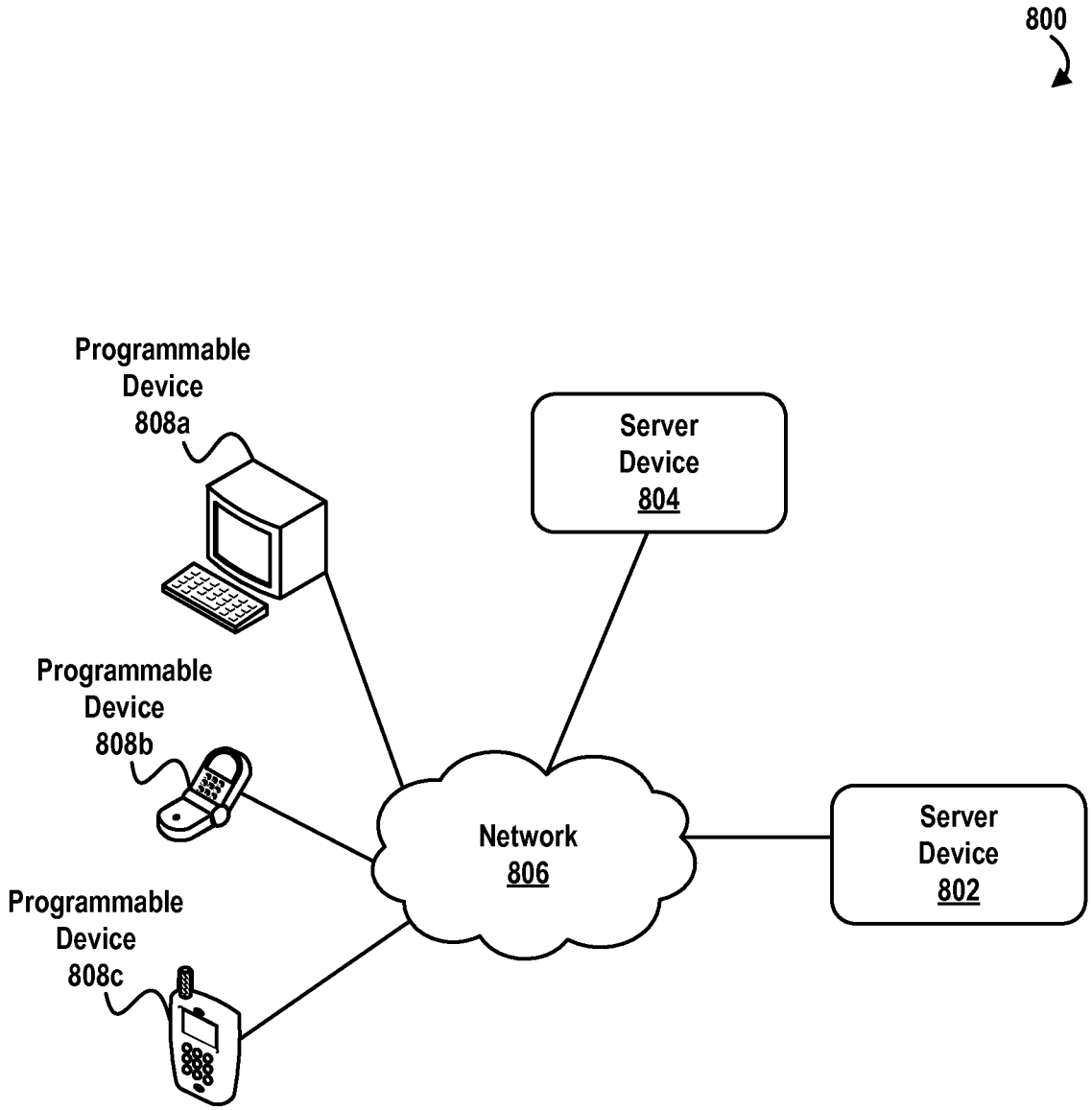
FIG. 8 illustrates an example distributed computing architecture, in accordance with at least some embodiments described herein.

FIG. 8 illustrates an example distributed computing architecture 800, in accordance with an example embodiment. FIG. 8 shows server devices 802 and 804 configured to communicate, via network 806, with programmable devices 808*a*, 808*b*, and 808*c*. The network 806 may correspond to a LAN, a wide area network (WAN), a corporate intranet, the public Internet, or any other type of network configured to provide a communications path between networked computing devices. The network 806 may also correspond to a combination of one or more LANs, WANs, corporate intranets, and/or the public Internet.

Although FIG. 8 shows three programmable devices, distributed application architectures may serve tens, hundreds, thousands, or any other number of programmable devices. Moreover, the programmable devices 808*a*, 808*b*, and 808*c* (or any additional programmable devices) may be any sort of computing device, such as an ordinary laptop computer, desktop computer, network terminal, wireless communication device (e.g., a tablet, a cell phone or smart phone, a wearable computing device, etc.), and so on. In some examples, the programmable devices 808*a*, 808*b*, and 808*c* may be dedicated to the design and use of software applications. In other examples, the programmable devices 808*a*, 808*b*, and 808*c* may be general purpose computers that are configured to perform a number of tasks and may not be dedicated to software development tools. For example the programmable devices 808*a*-808*c* may be configured to provide speech processing functionality similar to that discussed in FIGS. 1-7. For example, the programmable devices 808*a*-*c* may include a device such as the device 100.

The server devices 802 and 804 can be configured to perform one or more services, as requested by programmable devices 808*a*, 808*b*, and/or 808*c*. For example, server device 802 and/or 804 can provide content to the programmable devices 808*a*-808*c*. The content may include, but is not limited to, text, web pages, hypertext, scripts, binary data such as compiled software, images, audio, and/or video. The content can include compressed and/or uncompressed content. The content can be encrypted and/or unencrypted. Other types of content are possible as well.

As another example, the server device 802 and/or 804 can provide the programmable devices 808*a*-808*c* with access to software for database, search, computation (e.g., vocoder speech synthesis), graphical, audio (e.g. speech content), video, World Wide Web/Internet utilization, and/or other functions. Many other examples of server devices are possible as well. In some examples, the server devices 802 and/or 804 may perform at least some of the functions described in FIGS. 1-7.

The server devices 802 and/or 804 can be cloud-based devices that store program logic and/or data of cloud-based applications and/or services. In some examples, the server devices 802 and/or 804 can be a single computing device residing in a single computing center. In other examples, the server devices 802 and/or 804 can include multiple computing devices in a single computing center, or multiple computing devices located in multiple computing centers in diverse geographic locations. For example, FIG. 8 depicts each of the server devices 802 and 804 residing in different physical locations.

In some examples, data and services at the server devices 802 and/or 804 can be encoded as computer readable information stored in non-transitory, tangible computer readable media (or computer readable storage media) and accessible by programmable devices 808*a*, 808*b*, and 808*c*, and/or other computing devices. In some examples, data at the server device 802 and/or 804 can be stored on a single disk drive or other tangible storage media, or can be implemented on multiple disk drives or other tangible storage media located at one or more diverse geographic locations.

Figure 9:
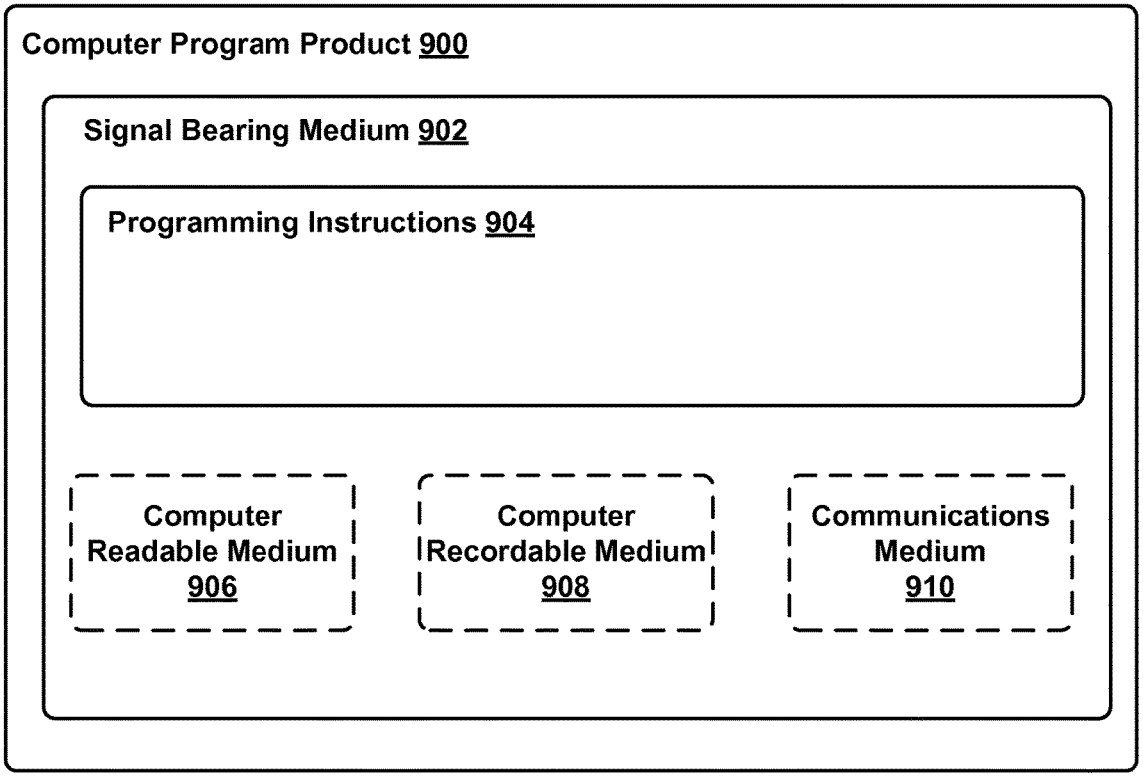
FIG. 9 depicts an example computer-readable medium configured according to at least some embodiments described herein.

FIG. 9 depicts an example computer-readable medium configured according to at least some embodiments described herein. In example embodiments, the example system can include one or more processors, one or more forms of memory, one or more input devices/interfaces, one or more output devices/interfaces, and machine readable instructions that when executed by the one or more processors cause the system to carry out the various functions tasks, capabilities, etc., described above.

As noted above, in some embodiments, the disclosed techniques (e.g. methods 300-700) can be implemented by computer program instructions encoded on a computer readable storage media in a machine-readable format, or on other media or articles of manufacture (e.g., the program instructions 110 of the device 100, or the instructions that operate the server devices 802-804 and/or the programmable devices 808*a*-808*c* in FIG. 8). FIG. 9 is a schematic illustrating a conceptual partial view of an example computer program product that includes a computer program for executing a computer process on a computing device, arranged according to at least some embodiments disclosed herein.

In one embodiment, the example computer program product 900 is provided using a signal bearing medium 902. The signal bearing medium 902 may include one or more programming instructions 904 that, when executed by one or more processors may provide functionality or portions of the functionality described above with respect to FIGS. 1-8. In some examples, the signal bearing medium 902 can be a computer-readable medium 906, such as, but not limited to, a hard disk drive, a Compact Disc (CD), a Digital Video Disk (DVD), a digital tape, memory, etc. In some implementations, the signal bearing medium 902 can be a computer recordable medium 908, such as, but not limited to, memory, read/write (R/W) CDs, R/W DVDs, etc. In some implementations, the signal bearing medium 902 can be a communication medium 910 (e.g., a fiber optic cable, a waveguide, a wired communications link, etc.). Thus, for example, the signal bearing medium 902 can be conveyed by a wireless form of the communications medium 910.

The one or more programming instructions 904 can be, for example, computer executable and/or logic implemented instructions. In some examples, a computing device, such as the processor-equipped device 100 of FIGS. 1A-1E and/or programmable devices 808*a-c* of FIG. 8, may be configured to provide various operations, functions, or actions in response to the programming instructions 904 conveyed to the computing device by one or more of the computer readable medium 906, the computer recordable medium 908, and/or the communications medium 910. In other examples, the computing device can be an external device such as server devices 802-804 of FIG. 8 in communication with a device such as the device 100 and/or the programmable devices 808*a*-808*c*.

The computer readable medium 906 can also be distributed among multiple data storage elements, which could be remotely located from each other. The computing device that executes some or all of the stored instructions could be an external computer, or a mobile computing platform, such as a smartphone, tablet device, personal computer, wearable device, etc. Alternatively, the computing device that executes some or all of the stored instructions could be remotely located computer system, such as a server. For example, the computer program product 900 can implement the functionalities discussed in the description of FIGS. 1-8.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A method comprising:

receiving, by a device that includes one or more processors, a speech signal;

determining acoustic feature parameters for the speech signal, wherein the acoustic feature parameters include phase data, wherein determining the phase data involves using a relative phase shift model;

based on determining the acoustic feature parameters, determining circular space representations for the phase data based on an alignment of the phase data with given axes of the circular space representations;

assigning, for the phase data, one or more statistical models adapted to indicate statistical distributions over a circular space, wherein assigning the one or more statistical models includes assigning a decision tree-clustered wrapped Gaussian model configured to identify a sequence of phase probability functions that provide a threshold likelihood of reproducing the speech signal;

mapping, based on the circular space representations, the sequence of phase probability functions, and the adapted one or more statistical models, the phase data to linguistic features associated with linguistic content that includes phonemic content or text content; and providing, based on the mapping, a synthetic audio pronunciation of the linguistic content.

2. The method of claim 1, wherein the one or more statistical models include one or more of a wrapped Gaussian Mixture Model (GMM), a wrapped Gaussian Probability Density Function (pdf), a Mixture von Mises pdf, a von Mises pdf, a decision tree-clustered wrapped GMM, a decision tree-clustered mixture von Mises pdf, a decision tree-clustered von Mises pdf, a neural network, a mixture density network, a recurrent neural network, or a long short-term memory.

3. The method of claim 1, further comprising:

determining the phase data based on the phase data being associated with reference time-instants of a glottal cycle in the speech signal.

4. The method of claim 3, wherein determining the phase data is based on measurements of phase at harmonic frequencies of the speech signal.

5. The method of claim 1, further comprising:

providing the phase data to a vocoder synthesis system, wherein providing the synthetic audio pronunciation is based on providing the phase data to the vocoder synthesis system.

6. The method of claim 5, wherein the vocoder synthesis system includes one or more of an Ahocoder system, a Harmonic-plus-Noise Model (HNM) system, a sinusoidal transform codec (STC) system, or a non-sinusoidal vocoder system.

7. A non-transitory computer readable medium having stored therein instructions, that when executed by a computing device, cause the computing device to perform functions comprising:

receiving a speech signal;

determining acoustic feature parameters for the speech signal, wherein the acoustic feature parameters include phase data, wherein determining the phase data involves using a relative phase shift model;

based on determining the acoustic feature parameters, determining circular space representations for the phase data based on an alignment of the phase data with given axes of the circular space representations;

assigning, for the phase data, one or more statistical models adapted to indicate statistical distributions mapped to a circular space, wherein assigning the one or more statistical models includes assigning a decision tree-clustered wrapped Gaussian model configured to identify a sequence of phase probability functions that provide a threshold likelihood of reproducing the speech signal;

mapping, based on the circular space representations, the sequence of phase probability functions, and the adapted one or more statistical models, the phase data to linguistic features associated with linguistic content that includes phonemic content or text content; and providing, based on the mapping, a synthetic audio pronunciation of the linguistic content.

8. The non-transitory computer readable medium of claim 7, wherein the one or more statistical models include one or more of a wrapped Gaussian Mixture Model (GMM), a wrapped Gaussian Probability Density Function (pdf), a Mixture of von Mises pdf, a decision tree-clustered wrapped GMM, a decision tree-clustered mixture von Mises pdf, a decision tree-clustered von Mises pdf, a neural network, a mixture density network, a recurrent neural network, or a long short-term memory.

9. The non-transitory computer readable medium of claim 7, the functions further comprising:

determining the phase data based on the phase data being associated with reference time-instants of a glottal cycle in the speech signal.

10. The non-transitory computer readable medium of claim 9, wherein determining the phase data is based on measurements of phase at harmonic frequencies of the speech signal.

11. The non-transitory computer readable medium of claim 7, the functions further comprising:

providing the phase data to a vocoder synthesis system, wherein providing the synthetic audio pronunciation is based on providing the phase data to the vocoder synthesis system.

12. The non-transitory computer readable medium of claim 11, wherein the vocoder synthesis system includes one or more of an Ahocoder system, a Harmonic-plus-Noise Model (HNM) system, a sinusoidal transform codec (STC) system, or a non-sinusoidal vocoder system.

13. A device comprising:

one or more processors; and data storage configured to store instructions executable by the one or more processors to cause the device to:

receive a speech signal;

determine acoustic feature parameters for the speech signal, wherein the acoustic feature parameters include phase data, wherein determining the phase data involves using a relative phase shift model;

based on determining the acoustic feature parameters, determine circular space representations for the phase data based on an alignment of the phase data with given axes of the circular space representations;

assign, for the phase data, one or more statistical models adapted to indicate statistical distributions mapped to a circular space, wherein assigning the one or more statistical models includes assigning a decision tree-clustered wrapped Gaussian model configured to identify a sequence of phase probability functions that provide a threshold likelihood of reproducing the speech signal;

map, based on the circular space representations, the sequence of phase probability functions, and the adapted one or more statistical models, the phase data to linguistic features associated with linguistic content that includes phonemic content or text content; and provide, based on the map, a synthetic audio pronunciation of the linguistic content.

14. The device of claim 13, wherein the one or more statistical models include one or more of a wrapped Gaussian Mixture Model (GMM), a wrapped Gaussian Probability Density Function (pdf), a Mixture of von Mises pdf, a decision tree-clustered wrapped GMM, a decision tree-clustered mixture von Mises pdf, a decision tree-clustered von Mises pdf, a neural network, a mixture density network, a recurrent neural network, or a long short-term memory.

15. The device of claim 13, wherein the instructions further cause the device to:

determine the phase data based on the phase data being associated with reference time-instants of a glottal cycle in the speech signal.

16. The device of claim 15, wherein determining the phase data is based on measurements of phase at harmonic frequencies of the speech signal.

17. The device of claim 13, wherein the instructions further cause the device to:

provide the phase data to a vocoder synthesis system, wherein providing the synthetic audio pronunciation is based on providing the phase data to the vocoder synthesis system.

* * * * *